US006654567B2

(12) United States Patent
Karakama et al.

(10) Patent No.: US 6,654,567 B2
(45) Date of Patent: Nov. 25, 2003

(54) PROCESS CARTRIDGE DETACHABLE FROM ELECTROPHOTOGRAPHIC IMAGE FORMING APPARATUS HAVING WIRELESS COMMUNICATION

(75) Inventors: Toshiyuki Karakama, Shizuoka-ken (JP); Kazushi Watanabe, Mishima (JP); Yoshihiro Ito, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/935,176

(22) Filed: Aug. 23, 2001

(65) Prior Publication Data

US 2002/0031359 A1 Mar. 14, 2002

(30) Foreign Application Priority Data

Aug. 25, 2000 (JP) ..... 2000-255804

(51) Int. Cl.[7] ..... G03G 15/00
(52) U.S. Cl. ..... 399/25; 399/111
(58) Field of Search ..... 399/12, 13, 24, 399/25, 27, 111, 90

(56) References Cited

U.S. PATENT DOCUMENTS

| | | | | |
|---|---|---|---|---|
| 5,926,666 A | * | 7/1999 | Miura et al. | 399/25 |
| 5,937,239 A | | 8/1999 | Watanabe et al. | 399/111 |
| 5,966,566 A | | 10/1999 | Odagawa et al. | 399/109 |
| 6,097,908 A | | 8/2000 | Uchiyama et al. | 399/111 |
| 6,385,407 B1 | * | 5/2002 | Inose | 222/DIG. 1 |
| 6,404,995 B1 | * | 6/2002 | Kimizuka | 399/111 |
| 2002/0025185 A1 | | 2/2002 | Ito et al. | |

FOREIGN PATENT DOCUMENTS

JP 11348375 A * 12/1999 ..... B41J/29/00

OTHER PUBLICATIONS

U.S. patent application Ser. No. 09/935,246, filed Aug. 23, 2001, pending.

U.S. patent application Ser. No. 09/935,242, filed Aug. 23, 2001, pending.

U.S. patent application Ser. No. 09/613,280, filed Jul. 10, 2000, allowed.

U.S. patent application Ser. No. 09/935,176, filed Aug. 23, 2001, pending this application.

U.S. patent application Ser. No. 09/633,256, filed Aug. 4, 2000, pending.

* cited by examiner

*Primary Examiner*—Robert Beatty
(74) *Attorney, Agent, or Firm*—Fitzpatrick, Cella, Harper & Scinto

(57) ABSTRACT

A process unit detachably mountable to a main assembly of an electrophotographic image forming apparatus for forming an image on a recording material, comprising a unit frame and a memory member provided in the process cartridge. The memory member includes a base; a storing element, provided on the base, for storing information; and a memory antenna, provided in the base, for sending the information stored in the storing element to a main assembly antenna provided in a main assembly of the apparatus. A sending member, provided in the base, sends information stored in the storing element to the memory antenna and an outer casing member covers the base provided with the storing element, the sending member and the memory antenna. When the memory unit is mounted to the main assembly of apparatus, the unit frame is contacted to a main assembly antenna cover provided in the main assembly of the apparatus.

13 Claims, 25 Drawing Sheets

FIG. 22
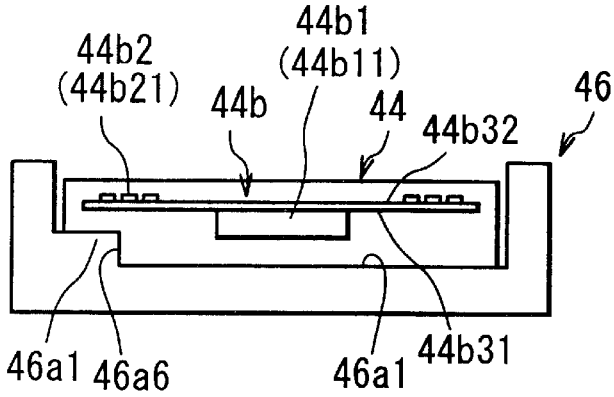
FIG. 23
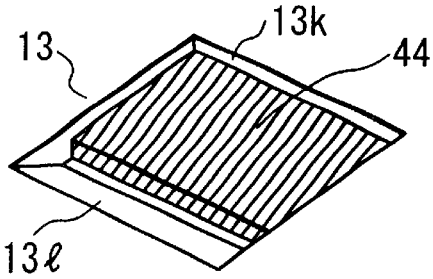
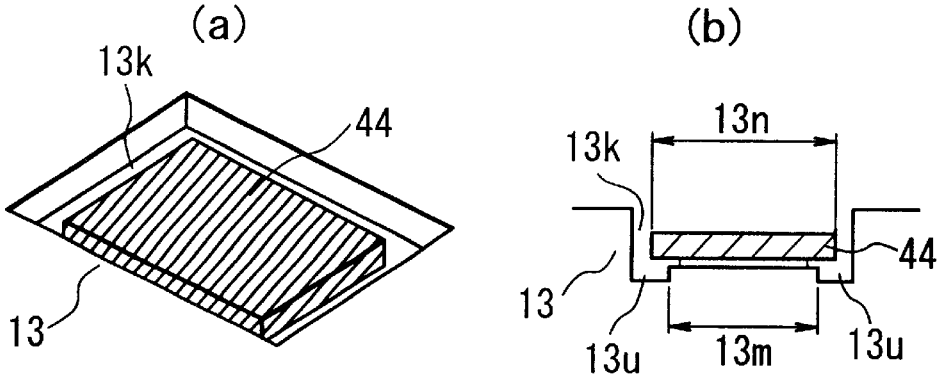
FIG. 24
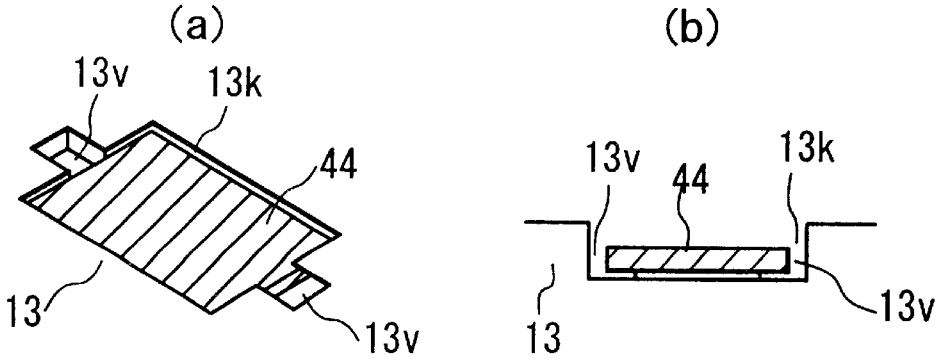
FIG. 25

PROCESS CARTRIDGE DETACHABLE FROM ELECTROPHOTOGRAPHIC IMAGE FORMING APPARATUS HAVING WIRELESS COMMUNICATION

FIELD OF THE INVENTION AND RELATED ART

The present invention relates to a unit, process cartridge and an electrophotographic image forming apparatus.

The electrophotographic image forming apparatus forms an image on a recording material through an electrophotographic image formation type process. The electrophotographic image forming apparatus may be an electrophotographic copying machine, an electrophotographic printer (a LED printer, a laser beam printer or the like), an electrophotographic printer type facsimile machine, an electrophotographic printer type word processor or the like.

The process cartridge is a cartridge containing as a unit an electrophotographic photosensitive member and charge means, developing means or cleaning means (process means), the unit being detachably mountable to the main assembly of the electrophotographic image forming apparatus. The process cartridge is a cartridge containing as a unit an electrophotographic photosensitive member and at least one of charge means, developing means and cleaning means (process means), the unit being detachably mountable to the main assembly of the electrophotographic image forming apparatus. The process cartridge may be a cartridge containing as a unit an electrophotographic photosensitive member and at least developing means (process means), the unit being detachably mountable to the main assembly of the electrophotographic image forming apparatus.

The unit is an assembly which is demountably mountable as a whole to the main assembly of the electrophotographic image forming apparatus. Examples of the unit include a fixing unit for fixing the toner image transferred onto the recording material, thereon, a developing unit for developing an electrostatic latent image formed on the electrophotographic photosensitive member, and a feeding unit for accommodating the recording material.

The memory member is mounted to the process cartridge or unit and stores information relating to the process cartridge or the unit. The memory member may be a FERAM, or a non-volatile memory such as a ferromagnetic memory or the like.

In an electrophotographic image forming apparatus using the electrophotographic image forming process, use has been made with the process cartridge type system in which the process cartridge comprises as a unit the electrophotographic photosensitive member and process means actable on the electrophotographic photosensitive member, the unit being detachably mountable to the main assembly of the electrophotographic image forming apparatus. With the use of the process cartridge type system, the maintenance operation can be carried out in effect by the users without necessity of relying on serviceman, and therefore, the operativity is improved. For this reason, it is widely used in the image forming apparatus.

For further easier maintenance operations for the main assembly of the image forming apparatus and for the process cartridge, the following method is use. A storing element (memory or storing means) is provided in the process cartridge, and the servicing information is stored in the storing element. When the process cartridge is mounted to the main assembly of the apparatus, a connector provided in the main assembly of the apparatus and a connector provision in the process cartridge are connected with each other. Through the connectors, the information in the storing element is taken by the main assembly of the apparatus. The main assembly of the apparatus discriminates the time of exchange of the process cartridge or the like, on the basis of the information. By doing so, the user is prompted for the maintenance operation of the process cartridge and/or the main assembly of the apparatus.

When the connectors are used for the electrical connection between the storing element provided in the process cartridge and the main assembly of the apparatus, the configuration of the process cartridge is complicated to permit the connector to be mounted. Therefore, the process cartridge tends to be bulky.

The present invention is intended to provides a further development of the above-described structure.

SUMMARY OF THE INVENTION

Accordingly, it is a principal object of the present invention to provide a process cartridge and an electrophotographic image forming apparatus in which there is provided a storing element for storing information, and the information stored in the storing element is transmitted to the main assembly of apparatus through an antenna.

It is another object of the present invention to provide a process cartridge and an electrophotographic image forming apparatus in which there is provided a storing element for storing information, and the information stored in the storing element is transmitted to the main assembly of apparatus without electrical contact to the main assembly of apparatus.

It is a further object of the present invention to provide a process cartridge and an electrophotographic image forming apparatus in which there is provided a storing element for storing information, and the information stored in the storing element is transmitted to the main assembly of the apparatus through wireless communication.

It is a further object of the present invention to provide a process cartridge and an electrophotographic image forming apparatus in which a gap between the main assembly of the memory antenna and the main assembly antenna can be maintained accurately.

According to an aspect of the present invention, there is provided an unit detachably mountable to a main assembly of an electrophotographic image forming apparatus for forming an image on a recording material, comprising:

(a) a unit including; a unit frame; and (b) a memory member provided in said process cartridge, said memory member having a base; a storing element, provided on said base, for storing information; a memory antenna, provided in said base, for sending the information stored in said storing element to a main assembly antenna provided in a main assembly of the apparatus, when said memory member is mounted to the main assembly of the apparatus; a sending member, provided in said base, for sending the information stored in said storing element to said memory antenna; and an outer casing member covering said base provided with said storing element, said sending member and said memory antenna, wherein when said unit is mounted to the main assembly of apparatus, the unit frame is contacted to a main assembly antenna cover provided in the main assembly of the apparatus.

According to another aspect of the present invention, there is provided a process cartridge detachably mountable to a main assembly of an electrophotographic image forming apparatus for forming an image on a recording material, comprising:

(a) electrophotographic photosensitive member;

(b) process means actable on said electrophotographic photosensitive member;

(c) a cartridge frame;

(d) a memory member provided in said cartridge frame, said memory member including; a base; a storing element, provided on said base, for storing information; a memory antenna, provided on said base, for sending the information stored in said storing element to a main assembly antenna provided in the main assembly of the apparatus when said process cartridge is mounted to the main assembly of the apparatus; a sending member, provided in said base, for sending the information stored in said storing element to said memory antenna; and an outer casing member covering said base provided with said storing element, said sending member and said memory antenna, wherein when said process cartridge is mounted to the main assembly of apparatus, the unit frame is contacted to a main assembly antenna cover provided in the main assembly of the apparatus.

According to a further aspect of the present invention, there is provided an electrophotographic image forming apparatus for forming an image on a recording material, to which apparatus a unit is detachably mountable, said apparatus comprising:

(a) a main assembly antenna covered with a main assembly antenna cover;

(b) a main assembly antenna holding member for holding said main assembly antenna;

(c) a unit including a unit frame; and a memory member provided in said process cartridge, said memory member having; a base; a storing element, provided on said base, for storing information; a memory antenna, provided in said base, for sending the information stored in said storing element to a main assembly antenna provided in a main assembly of the apparatus, when said unit is mounted to the main assembly of the apparatus; a sending member, provided in said base, for sending the information stored in said storing element to said memory antenna; and an outer casing member covering said base provided with said storing element, said sending member and said memory antenna;

said apparatus further comprising:

(d) feeding means for feeding the recording material, wherein when said unit is mounted to the main assembly of apparatus, the unit frame is contacted to a main assembly antenna cover provided in the main assembly of the apparatus.

According to a further aspect of the present invention, there is provided an electrophotographic image forming apparatus for forming an image on a recording material, to which a process cartridge is detachably mountable, said electrophotographic image forming apparatus comprising:

(a) a main assembly antenna covered with a main assembly antenna cover;

(b) a main assembly antenna holding member for holding said main assembly antenna;

(c) mounting means for detachably mounting a process cartridge, said process cartridge including; an electrophotographic photosensitive member; process means actable on said electrophotographic photosensitive member; a cartridge frame; a memory member provided in said process cartridge, said memory member having; a base; a storing element, provided on said base, for storing information; a memory antenna, provided in said base, for sending the information stored in said storing element to a main assembly antenna provided in a main assembly of the apparatus, when said process cartridge is mounted to the main assembly of the apparatus; a sending member, provided in said base, for sending the information stored in said storing element to said memory antenna; and an outer casing member covering said base provided with said storing element, said sending member and said memory antenna;

said apparatus further comprising:

(d) feeding means for feeding the recording material, wherein when said process cartridge is mounted to the main assembly of apparatus, the unit frame is contacted to a main assembly antenna cover provided in the main assembly of the apparatus.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 16 FIG. 11 is a sectional view of a memory unit shown in FIG. 9 according to a further embodiment.

FIG. 22 is a sectional view of the parts feeder and the memory unit shown in FIG. 21.

FIG. 23 is an illustration of a memory unit mounting portion having a tool inserting portion according to a first embodiment of the present invention.

FIG. 24 is an illustration of a memory unit mounting portion having a tool inserting portion according to a second embodiment of the present invention.

FIG. 25 is an illustration of a memory unit mounting portion having a tool inserting portion according to a third embodiment of the present invention.

DESCRIPTION OF THE PREFERRED EMBODIMENTS

The preferred embodiments of the present invention will be described in conjunction with the accompanying drawings.

In the specification, the lateral direction or widthwise direction is the direction in which the process cartridge B is mounted to the main assembly 14 of the electrophotographic image forming apparatus A, and is the same as the feeding direction of the recording material. The longitudinal direction of the process cartridge B is the direction crossing (substantially perpendicular) with the direction in which the process cartridge is mounted to or demounted from the main assembly 14 of the image forming apparatus, and it is parallel with the surface of the recording material and is crossing (substantially perpendicular) with the feeding direction of the recording material. With respect to the process cartridge, the left and right is those as seen in the feeding direction of the recording material and from the top side. An upper surface of the cartridge B is a surface taking an upper position, and the lower surface is a surface taking a lower position, when the cartridge B is mounted to the main assembly 14 of the apparatus.

Figure 1:
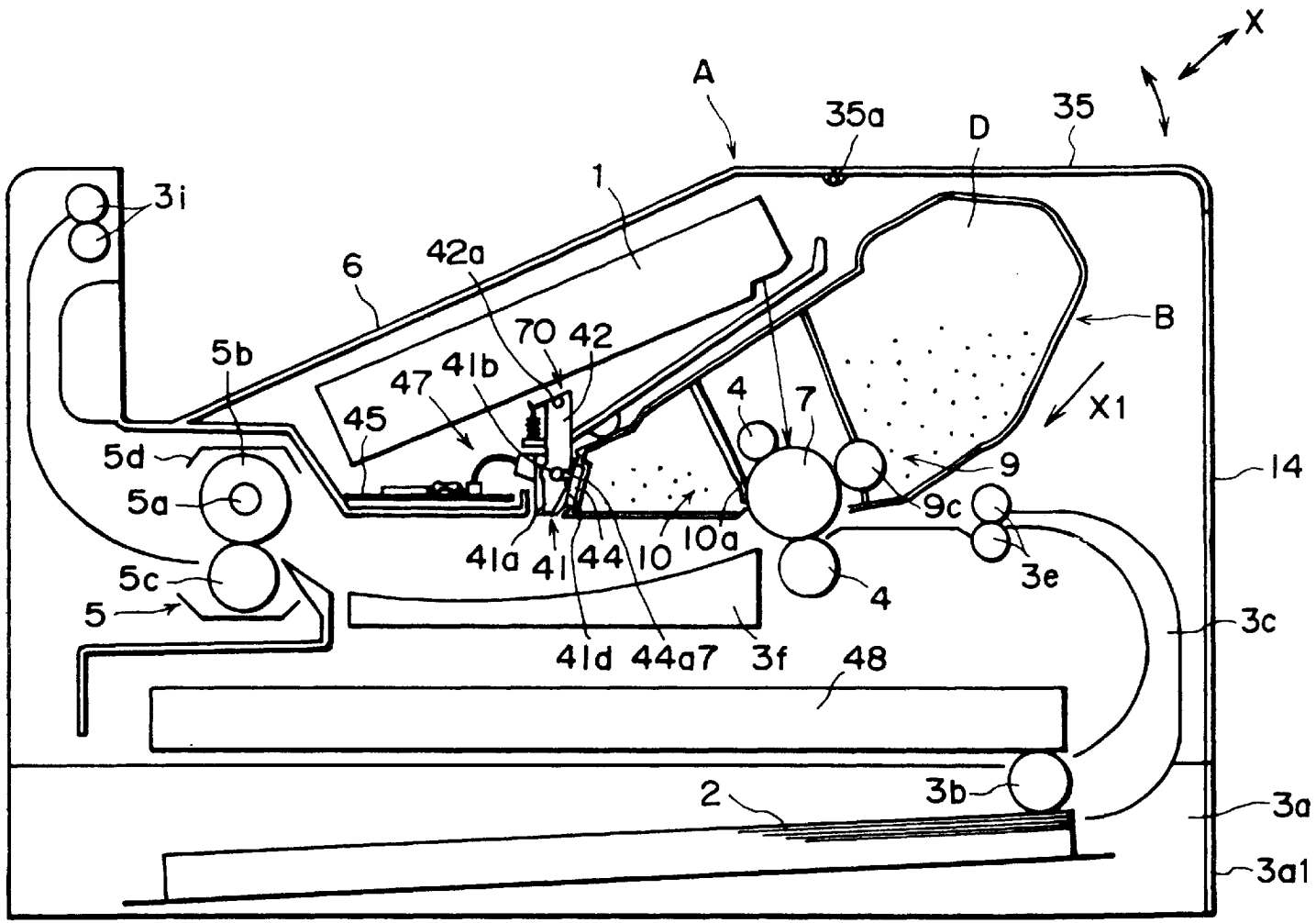
FIG. 1 is a sectional side elevation of an electrophotographic image forming apparatus.
Figure 2:
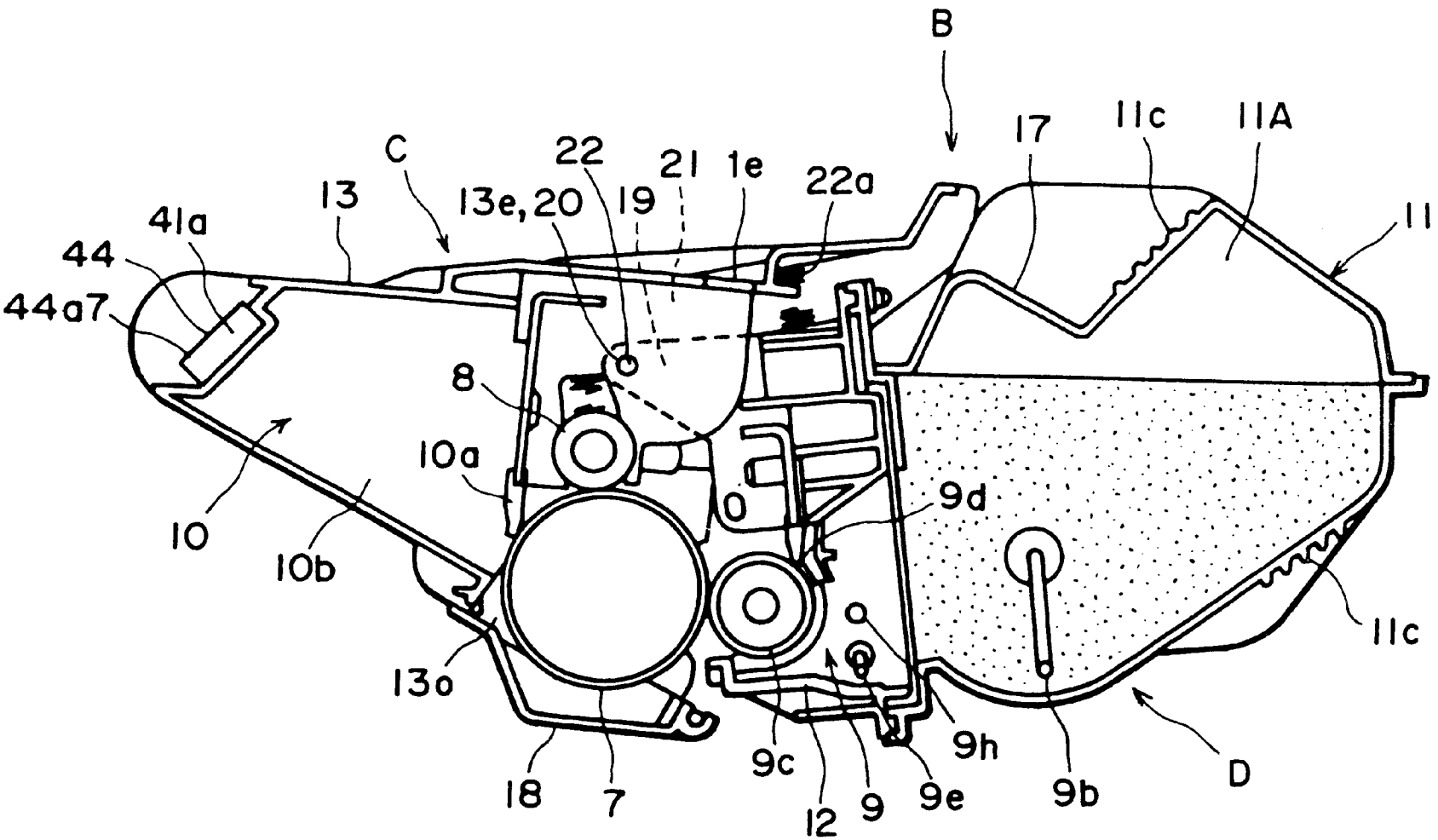
FIG. 2 is a sectional side elevation of a process cartridge.
Figure 3:
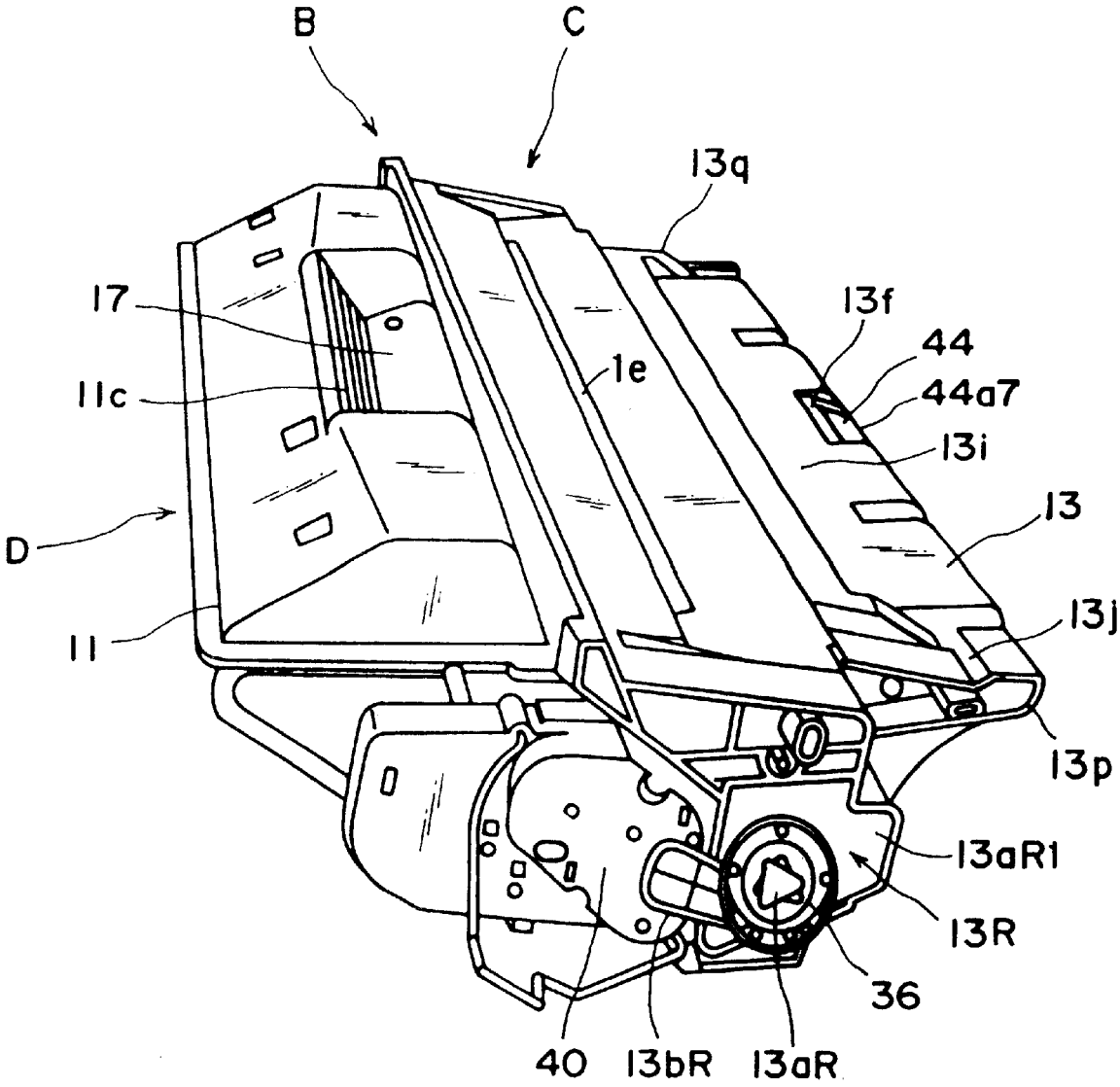
FIG. 3 is a schematic perspective view of a process cartridge.
Figure 4:
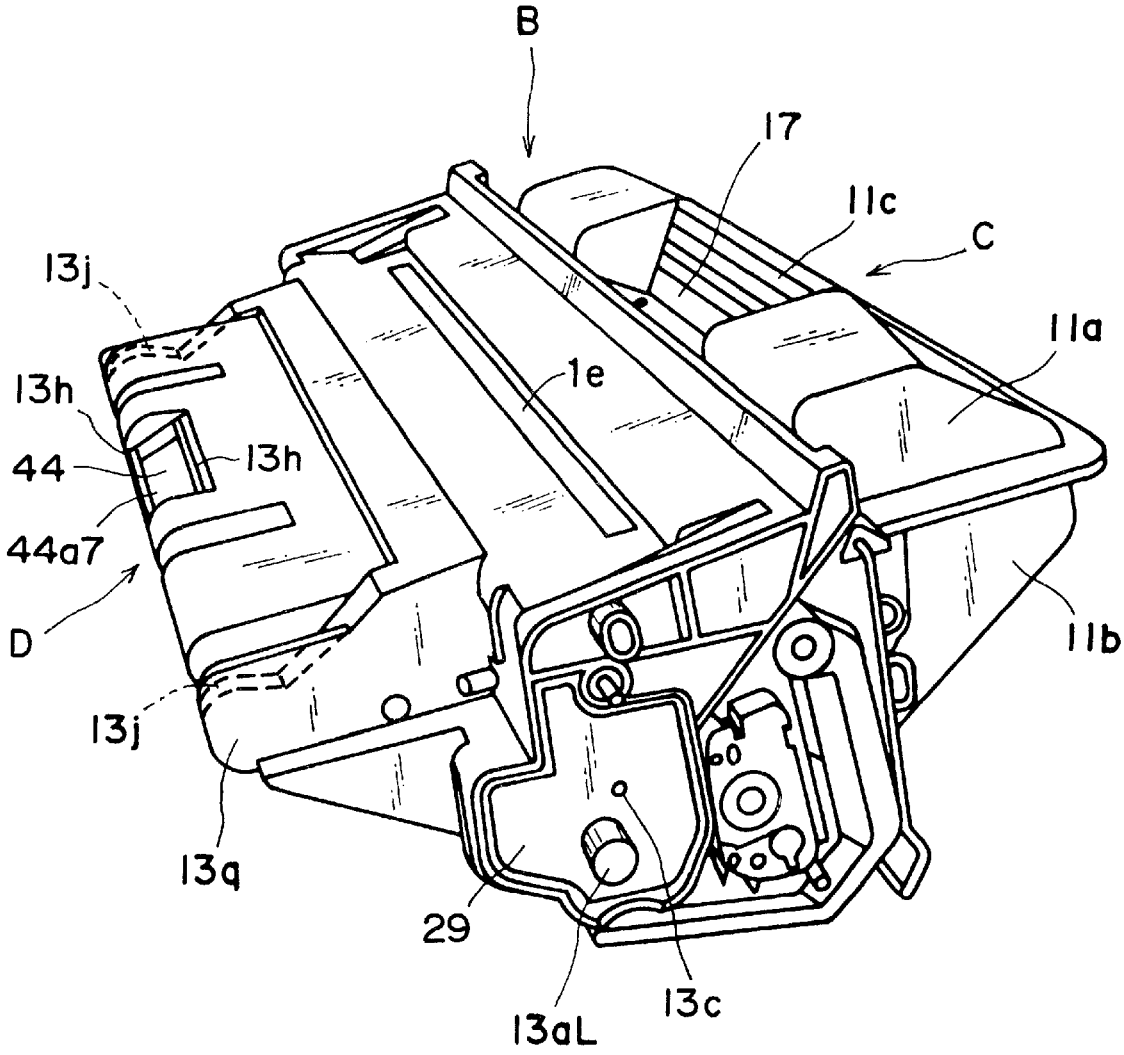
FIG. 4 is a schematic perspective view of a process cartridge.

FIG. 1 is an illustration of an electrophotographic image forming apparatus (laser beam printer) according to an embodiment of the present invention. FIGS. 2–4 are related with a cartridge according to an embodiment of the present invention. FIG. 2 is a sectional side elevation of a cartridge, FIG. 3 is a perspective view of an outer appearance of the cartridge, and FIG. 4 is a perspective view of the as seen from a top side thereof.

The description will be made as to the general arrangements of the cartridge and the electrophotographic image forming apparatus, and then as to the structure of the cartridge.

General Arrangement

Referring to FIG. 1, the electrophotographic image forming apparatus (laser beam printer) An according to an embodiment of the present invention will be described. FIG. 2 is a sectional side elevation of the cartridge B.

As shown in FIG. 1, the image forming apparatus An operates to form an image on a recording material (recording paper, OHP sheet, textile or the like) 2 through an electrophotographic image forming process. A toner (developer) image is formed on an electrophotographic photosensitive member in the form of a drum (photosensitive drum). More particularly, the photosensitive drum is electrically charged by charging means. Then, the photosensitive drum is exposed to a laser beam modulated in accordance with image information by optical means so that electrostatic latent image is formed in accordance with the image information on the photosensitive drum. Subsequently, the electrostatic latent image is developed by developing means to form a toner image. Then, in synchronism with the formation of the toner image, the recording material 2 in the sheet feeding cassette 3*a* (feeding unit) is fed by a pick-up roller 3*b* along a feeding path 3*c* to a pair of registration rollers 3*e*. The toner image formed on the photosensitive drum 7 provided in the cartridge B is transferred onto the recording material 2 fed at times the relation with the image by the registration rollers, by application of the voltage to the transfer roller 4. Thereafter, the recording material 2 having received the toner image is fed to the fixing unit 5 along the feeding guide 3*f*. The fixing means 5 comprises a driving roller (pressing roller) and a fixing roller 5*b* having a heater 5*a* therewithin. The toner image on the recording material 2 is fixed by application of heat and pressure. The recording material 2 is discharged to the discharging tray 6 by a pair of discharging rollers 3*i*. Here, the feeding cassette 3*a* is demountable to the main assembly 14 of the image forming apparatus. The feeding cassette 3*a* comprises a cassette frame 3*b* (unit frame), and accommodates the recording materials 2 in the cassette frame 3*b*. The fixing unit 5 has a unit frame 5*d* as a unit frame. The unit frame 5*d* rotatably supports the driving roller 5*c* and the fixing roller 5*b*. In FIG. 1, designated by reference numeral 48 is a controlling unit. The controlling unit 48 functions to control the entirety of the electrophotographic image forming apparatus A.

In this embodiment, the developing means 9 is provided in the process cartridge B. However, the developing means 9 may be an independent developing unit which is detachably mountable to the main assembly 14 of the apparatus.

Process Cartridge

On the other hand, the cartridge B comprises the electrophotographic photosensitive member and at least one of process means. The process means includes charging means for electrically charging the electrophotographic photosensitive member, the developing means for developing the electrostatic latent image formed on the electrophotographic photosensitive member, cleaning means for cleaning the surface of the electrophotographic photosensitive member to remove the residual toner, or the like. As shown in FIGS. 2–4, in the cartridge B of this embodiment, the photosensitive drum 7 having a photosensitive layer is rotated, and the surface thereof is uniformly charged by application of a voltage to the charging roller 8. Then, a laser beam modulated in accordance with image information and supplied from an exposure device 1 (optical means) is projected onto the surface of the photosensitive drum 7 through an exposure opening 1*e,* by which electrostatic latent image is formed. Then, the electrostatic latent image is developed by developing means 9 using toner. The charging roller 8 is provided contacted to the photosensitive drum 7 to electrically charge it. The charging roller 8 is driven by the photosensitive drum 7. The developing means 9 supplies the toner to a developing zone of the photosensitive drum 7 to develop the electrostatic latent image formed on the photosensitive drum 7.

Here, the developing means 9 feeds the toner from the toner container 11A toward the developing roller 9*c* by rotation of the toner feeding member 9*b*. The developing roller 10*d* containing therein a fixed magnet 10*c* is rotated, and a layer of toner triboelectrically charged by a developing blade 10*e* is formed on a surface of the developing roller 10*d*. The toner is supplied to the developing zone of the photosensitive drum 7. The toner image is formed (visualization) by transferring the toner in accordance with the electrostatic latent image onto the photosensitive drum 7. Here, the developing blade 9*d* functions to regulate the amount of the toner applied on the peripheral surface of the developing roller 9*c* and to apply the triboelectric charge to the toner particles. A rotatable toner stirring member 9*e* is provided adjacent to the developing roller 9*c* to circulate the toner in the developer chamber.

In the next station, there is a transfer roller 4 which is supplied with a voltage having a polarity opposite from that of the toner image. By doing so, the toner image formed on the photosensitive drum 7 is transferred on to the recording material 2. Thereafter, the photosensitive drum 7 is cleaned by the cleaning means 10 so that residual toner thereon is removed. The cleaning means 10 comprises an elastic cleaning blade 10*a* contacted to the photosensitive drum 7 and functions to scrape the residual toner off the photosensitive drum 7 and collect the scraped toner in a removed toner container 10*b*.

The cartridge B comprises a toner frame 11 having a toner container (toner accommodating portion) 11A for accommodating the toner, and a developing frame 12 supporting developing members such as a developing roller 9*c,* a developing blade 9*d* or the like, which frames are coupled with each other. To the coupled frames 11, 12, the cleaner frame 13 supporting the photosensitive drum 7, the cleaning means 10 such as the cleaning blade 10*a* and the charging roller 8, is coupled.

The cartridge B is detachably mountable to the main assembly 14 of the apparatus by the user.

The process cartridge B is provided with an exposure opening 1*e* for permitting exposure of the photosensitive drum 7 to the image information light and with an opening for facing the photosensitive drum 7 to the recording material 2. The exposure opening 1*e* is formed in the cleaner frame 13. The transfer opening 13*o* is formed between the developing frame 12 and the cleaner frame 13.

The description will be made as to the structures of the housing (the cartridge frame).

The cartridge B in this embodiment is constituted by the toner frame 11 and the developing frame 12 which are coupled with each other. The cleaner frame 13 is rotatably coupled with the frame constituted by the frames 11, 12, by which the housing is constituted. The photosensitive drum 7, the charging roller 8, the developing means 9, the cleaning means 10 and the like, are contained in the housing to constitute the cartridge. The cartridge B is demountably mounted to the main assembly 14 of the apparatus by the operator moving it in the direction of arrow X (FIG. 1) to the cartridge mounting means.

Structure of Housing of Cartridge

The cartridge B of this embodiment, as described hereinbefore, is constituted by the toner frame 11, the developing frame 12 and the cleaner frame 13 which are coupled to constitute the housing. The description will be made as to the structure thereof.

As shown in FIG. 2, the toner feeding member 9*b* is rotatably mounted to the toner frame 11. The developing roller 9*c* and the developing blade 9*d* are mounted to the developing frame 12. Furthermore, a toner stirring member 9*e* for circulating the toner in the developer chamber is rotatably mounted to the neighborhood of the developing roller 9*c*. To the developing frame 12, as shown in FIG. 2, an antenna rod 9*h* is mounted and extended substantially parallel with the developing roller 9*c*. The toner frame 11 and the developing frame 12 are welded with each other (ultrasonic welding in this embodiment) to constitute an integral developing unit D.

The developing unit D is provided with a drum shutter member 18 which functions to cover the photosensitive drum 7 when the cartridge B is dismounted from the main assembly 14 of the apparatus. The shutter member 18 is effective to prevent the photosensitive drum 7 from being exposed to light for a long term or to prevent it from being contacted by the foreign matter.

As shown in FIG. 2, the cleaner frame 13 supports the photosensitive drum 7, the charging roller 8 and the cleaning means 10 to constitute a cleaning unit C.

The developing unit D and the cleaning unit C are rotatably coupled with each other by a day connecting member (pin) 22. In this manner, the cartridge B is constructed. As shown in FIG. 2, the developing frame 12 is provided at each of the opposite longitudinal ends (the axial direction of the developing roller 9*c*) with an arm portion 19. On the other hand, the cleaner frame 13 is provided at each of the opposite ends thereof with a recess 21 for receiving the arm portion 19. By inserting the arm portion 19 into the recess 21, and a connecting member 22 is press fitted into holes 13*e,* 20 formed in the cleaner frame 13 and in the arm portion 19. By this, the developing unit D and the cleaning unit C are coupled for rotation about the connecting member 22. At this time, a compression coil spring 22*a* mounted to a dowel (unshown) provided at a base portion of the arm portion 19 is abutted to an upper wall of the recess 21 of the cleaner frame 13. Thus, the developing frame 12 is urged downward by the elastic force of the spring 22*a*. By this, the developing roller 9*c* is assuredly urged to the photosensitive drum 7 through spacer rollers (unshown).

Structure of Guide Means of Cartridge

Figure 5:
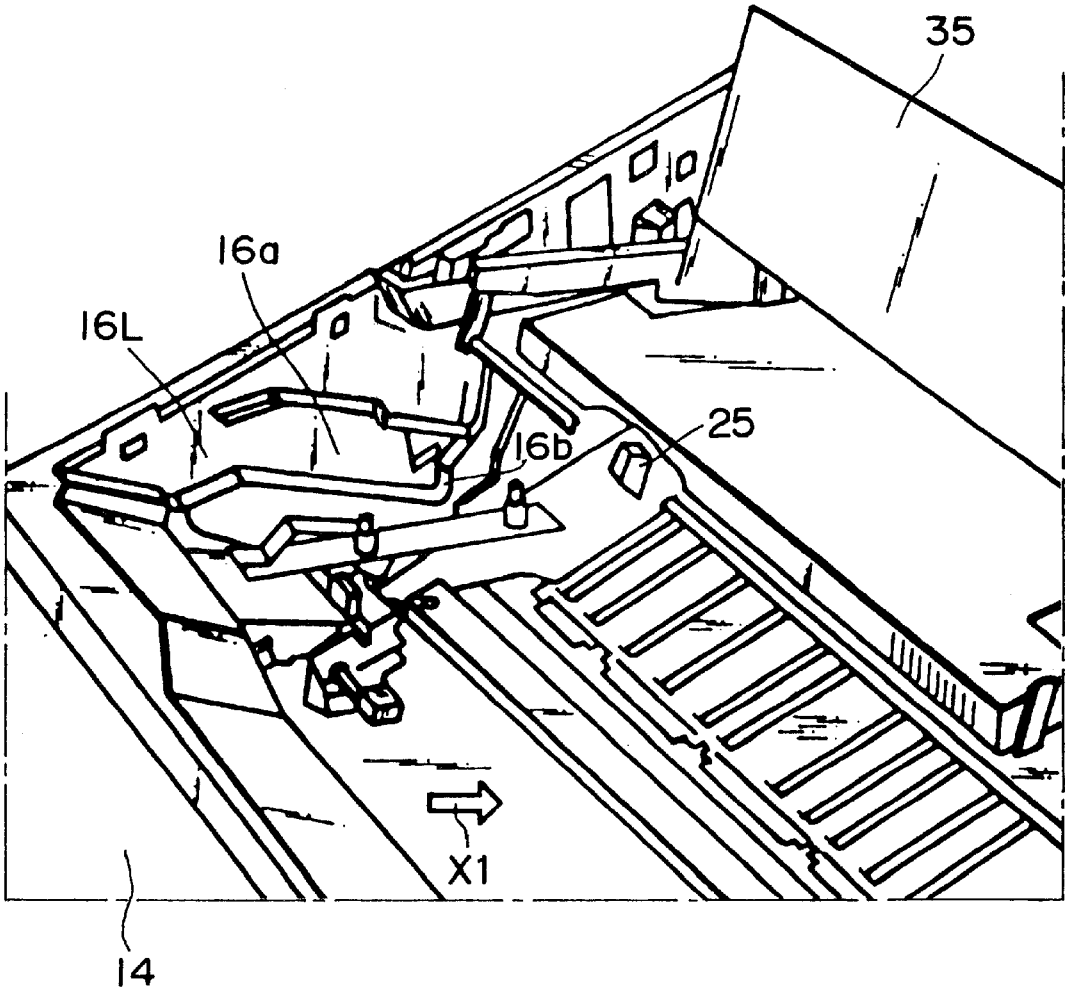
FIG. 5 is a perspective view of a process cartridge mounting portion provided in a main assembly of the apparatus.
Figure 6:
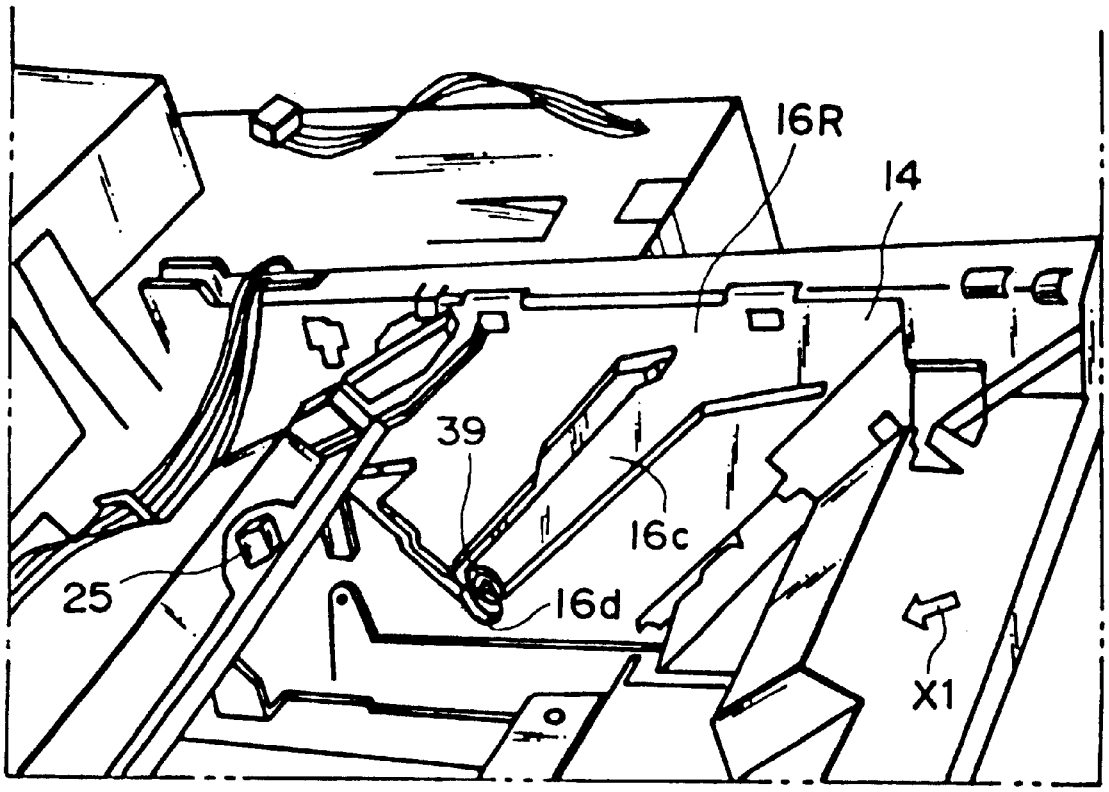
FIG. 6 is a perspective view of a process cartridge mounting portion provided in a main assembly of the apparatus.

The description will be made as to the guide means for guiding the process cartridge B when it is mounted to the main assembly 14 of the apparatus. FIGS. 5 and 6 show the guide means. FIG. 5 is a perspective view as seen from the left side (from the developing unit D side) in the direction (arrow X) in which the process cartridge B is mounted to the main assembly A. FIG. 6 is a perspective view of the righthand side.

As shown in FIGS. 3 and 4, each of the opposite ends of the cleaner frame 13 is provided with guide means to be guided when the cartridge B is mounted to the main assembly 14 of the apparatus. The guide means comprises cylindrical guides 13*a*R, 13*a*L functioning as a guide member for determining the position of the cartridge relative to the main assembly of t apparatus, and an anti-rotation guide 13*b*R functioning as a stopper for preventing rotation of the process cartridge when it is mounted to the main assembly of the apparatus.

As shown in FIG. 3, the guide 13*a*R is in the form of a hollow cylindrical member. The guide 13*b*R is integrally formed with the guide 13*a*R, and is extended radially outwardly along a line from the circumference of the guide 13*a*R. The guide 13*a*R is provided with an integral flange 13*a*R1. The right-hand side guide member 13R having the guide 13*a*R, guide 13*b*R and the flange 13*a*R1 is fixed to the cleaner frame 13 by screws (unshown) threaded through the screw holes of the flange 13*a*R1. The guide 13*b*R of the right-hand side guide member 13R fixed to the cleaner frame 13 is disposed adjacent the side surface of the developing frame 12 such that it is extended to extend over the end of the development holder 40 fixed to the developing frame 12.

As shown in FIG. 4, to the side surface of the cleaner frame 13, a flange 29 in the form of a flat plate is engaged with the positioning pin 13*c* for anti-rotation, and is fixed to the cleaner frame 13 by screws (unshown). The flange 29 is provided with a cylindrical guide 13*a*L extended outwardly in the direction of the axis of the photosensitive drum 7.

The description will be made as to a regulating abutment 13*j* provided on the upper surface 13*i* of the cleaning unit C. Here, the upper surface is the surface which takes an upper position when the cartridge B is mounted to the main assembly 14 of the apparatus.

In this embodiment, as shown in FIGS. 3 and 4, the regulating abutment 13*j* is provided a right-hand end 13*p* and left-hand end 13*q* in the direction perpendicular to the mounting direction of the cartridge, on the upper surface 13*i* of the cleaning unit C. The contact portion 13*j* functions to regulate the position of the cartridge B when the cartridge B is mounted to the main assembly 14 of the apparatus. Therefore, when the cartridge B is mounted to the main assembly 14 of the apparatus, the regulating abutment 13*j* is contacted to the fixing member 25 (FIGS. 5 and 6) provided in the main assembly 14 of the apparatus. By this, the angular position of the cartridge B about the guides 13*a*R, 13*a*L, is determined.

The description will be made as to the guide means (mounting means) provided in the main assembly 14 of the apparatus. When the opening and closing member 35 of the main assembly 14 of the apparatus is rotated in the couterclockwise direction in FIG. 1 about the fulcrum 35*a,* the upper portion of the main assembly 14 of the apparatus is opened. By this, the mounting portion of the cartridge B can be seen (FIGS. 5, 6). Left and right inner walls of the main assembly 14 of the apparatus are provided with guide members 16L, 16R, respectively.

The guide member 16R, 16L are provided with guide portions 16*a,* 16*c* which is inclined downward as seen in a direction of arrow X (inserting direction of the cartridge B) and semicircular positioning grooves 16*b,* 16*d* which continue from the guide portions 16*a,* 16*c* and into which the guides 13*a*R, 13*a*L of the cartridge B are snugly fitted. The grooves 16*b,* 16*d* have a cylindrical circumference walls. The centers of the grooves 16*b,* 16*d* are concentric with the center of the guides 13*a*R, 13*a*L of the cartridge B when the cartridge B is mounted to the main assembly 14 of the apparatus. Therefore, they are concentric with the photosensitive drum 7.

The guide portions 16*a,* 16*c* of the are so large that guides 13*a*R, 13*a*L are loosely fitted therein in the mounting-and-demounting direction of the cartridge B. The guide 13*b*R is therefore loosely fitted, since it has a width smaller than the diameter of the guide 13*a*R. However, guides 13*a*R, 13*a*L and the guide 13*b*R are limited in the rotational direction by the guide portion 16*a.* By this, the cartridge B is mounted to the main assembly 14 of the apparatus with an orientation within a limited range. When the cartridge B has been mounted to the main assembly 14 of the apparatus, the guides 13*a*R, 13*a*L of the cartridge B are engaged with the grooves 16*b,* 16*d.* And, the contact portion 13*j* is contacted to the fixing member 25 of the main assembly 14 of the apparatus.

The weight distribution of the cartridge B is such that when the center line connecting the centers of the guides 13*a*R, 13*a*L, the developing unit D side is heavier than the cleaning unit C side, and therefore, the resulting statical moment is in the direction of lowering the developing unit D side.

When the user mounts the cartridge B into the main assembly 14 of the apparatus, the users hand grips the toner frame 11 shown in FIG. 2 at the recess 17 and the lower side rib 11*c.* Then, the guides 13*a*R, 13*a*L are inserted along the guide portions 16*a,* 16*c,* and the guide 13*b*R is inserted into the guide portion 16*c* of the main assembly 14 of the apparatus. Finally, a drive transmitting member 36 (FIG. 3) provided integrally with a drum gear (unshown) fixed to the end of the photosensitive drum 7 is engaged with a drive transmitting member 39 (FIG. 6) provided in the groove 16*b,* so that position of the photosensitive drum 7 relative to the main assembly 14 of the apparatus is determined.

The steps of dismounting the cartridge B from the main assembly 14 of the apparatus are opposite from the steps described in the foregoing. More particularly, the user opens the opening and closing member 35, and grips the grip portion of the cartridge B at the upper and lower rib 11*c* and raises the cartridge B. Then, the user pulls the cartridge B along the guide portions 16*a,* 16*b.*

The photosensitive drum 7 of the cartridge B is provided with a spur gear (unshown) at the opposite end of the drive transmitting member 36. The spur gear is brought into meshing engagement with a gear (unshown) which is coaxial with a transfer roller 4 provided in the main assembly 14 of the apparatus when the cartridge B is mounted to the main assembly 14 of the apparatus, so that driving force for rotating the transfer roller 4 is transmitted from the cartridge B to the transfer roller 4.

Wireless Communication System

The description will be made as to an information communication system of a wireless type for communication between the main assembly 14 of the apparatus and the cartridge B.

In this embodiment, the wireless communication system is such that cartridge B is provided with a magnetic core which functions as a communication antenna. The main assembly 14 of the apparatus is provided with an inductor which functions as a communication antenna. When the cartridge B is mounted to the main assembly 14 of the apparatus, the information communication between the main assembly 14 and the cartridge B is wirelessly carried out through electromagnetic induction of inductor type through the magnetic core. In other words, in this embodiment, the information communication between the main assembly 14 of the apparatus and the cartridge B is effected between antennas using the electromagnetic energy. Thus, the information communication is carried out wirelessly. By doing so, the possible size-increase of the cartridge B is avoided, and communication trouble due to mechanical improper contact between connectors for information transmission provided in the main assembly 14 of the apparatus and in the cartridge B.

Referring to FIGS. 1, 3, 4, 7, 8, the description will be made as to the wireless communication system according to an embodiment of the present invention.

As shown in FIGS. 1, 3, 4, 7, the cartridge 2 is provided with a memory unit 44 (memory member). The main assembly 14 of the apparatus is provided with a communicating unit 47 (main assembly communicating means). The communicating unit 47 comprises a communication controlling unit 45 fixed to the main assembly 14 of the apparatus, an equalizer mechanism 70 provision in the main assembly 14 of the apparatus, and an antenna unit 41 (main assembly antenna) connected to the communication controlling unit 45. Between the memory unit 44 provided in the cartridge B and the communicating unit 47 provided in the main assembly 14 of the apparatus, the communication is electrically carried out without contact. That is, the wireless information communication is provided. As shown in FIG. 8 when the cartridge B is mounted to the main assembly 14 of the apparatus, the communication antenna 44*b*2 (memory antenna) provided in the unit 44 and the communication antenna 41*c* (main assembly antenna) provided in the antenna unit 41, are faced to each other with correct positioning accomplished by the equalizer mechanism 70. More particularly, by the abutment of the frame member 44*a* (outer casing member) to the antenna cover 41*a*, the gap is regulated between the communication antenna 44*b*2 (memory antenna) and the communication antenna 41*c* (main assembly antenna). Then, the electric energy is supplied to the storing element 44*b*1 of the unit 44, so that wireless commutation between the unit 45 and the storing element 44*b*1 is enabled. Thus, information can be read from or written in the storing element 44*b*1.

The description will be made as to the wireless communication system, more particularly, the memory unit, arrangement and structure of the memory unit, an abutment structure between the memory unit and the antenna unit and the structure of the wireless communicating mechanism, in the order named.

I. Memory Unit

Memory Unit Structure 1

First Embodiment

Figure 9:
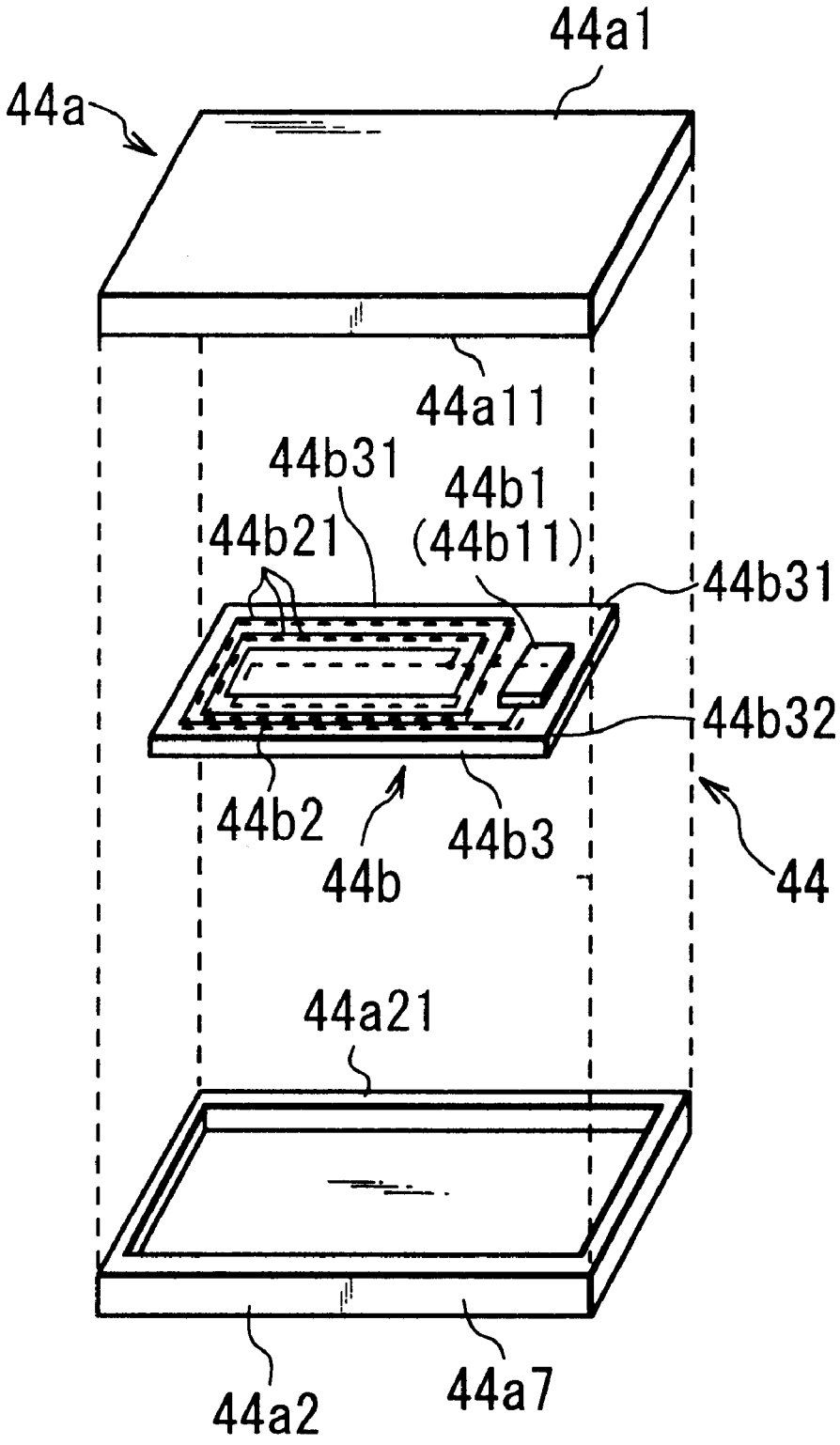
FIG. 9 is an exploded perspective view of a memory unit wherein the storing element is disposed outside a communication antenna.

Referring to FIG. 9, a structure of the memory unit will be described. FIG. 9 is an exploded perspective view of a memory unit.

An unit 44 is in the form of a tag comprising a substrate unit 44*b* and a frame member 44*a* outer casing member) covering the substrate unit 44*b*. The substrate unit 44*b* includes a storing element 44*b*1 for storing information, an antenna 44*b*2 magnetic core as a memory antenna) for communication and a substrate 44*b*3 for carrying the storing element 44*b*1 and the communication antenna 44*b*2, as a unit. The storing element 44*b*1 is provided on a rectangular substrate 44*b*3 made of epoxy resin material. More particularly, the storing element 44*b*1 is provided on a back side 44*b*31 of the substrate 44*b*3 (the side opposite from the side which is faced to the antenna unit 41 provided in the main assembly 14 of the apparatus), and is disposed outside a conduction pattern 44*b*21 constituting the antenna 44*b*2. The storing element 44*b*1 comprises a FERAM. The storing element 44*b*1 is integral with a sending circuit 44*b*11 (sending member) shown in FIG. 15. The sending circuit 44*b*11 functions to send the information stored in the storing element 44*b*1 to the antenna 44*b*2. The sending circuit 44*b*11 will be described in detail hereinafter. The antenna 44*b*2 has an electroconductive pattern 44*b*21 in the form of a volute extended on the substrate 44*b*3 along the sides of the rectangular shape of the substrate 44*b*3. The pattern 44*b*21 is formed continuously on the back side 44*b*31 and on the surface 44*b*32 of the substrate 44*b*3 by printing. The pattern 44*b*21 is connected with a storing element 44*b*1 FERAM, for example).

In summary, the back side 44*b*31 of the substrate 44*b*3 is provided with the storing element 44*b*1, the sending circuit 44*b*11 and the electroconductive pattern 44*b*21 (memory antenna). The memory antenna, at its one and the other ends, is electrically connected to the sending circuit 44*b*11.

The substrate unit 44*b* having such a structure is disposed in a frame member 44*a* functioning as an outer casing member. The frame member 44*a* comprises an upper outer casing portion (upper frame 44*a*1) made of polystyrene resin material and a lower outer casing portion (lower frame 44*a*2). The upper frame 44*a*1 and the lower frame 44*a*2 are provided with projected portions 44*a*11, 44*a*21 at the circumference thereof. The projected portions 44*a*11, 44*a*21 of the upper frame 44*a*1 and the lower frame 44*a*2 are contacted to each other to constitute a frame member 44*a*. The projected portions 44*a*11, 44*a*21 of the upper frame 44*a*1 and the lower frame 44*a*2 are fixed by an adhesive material, welding, ultrasonic welding or the like after the substrate unit 44*b* is inserted. The material of the frame member 44*a* has a physical strength against the abutment to the unit 41 constituting the unit 47 of the main assembly 14, and has an electrostatic shield property. More particularly, the frame member 44*a* is made of a material having a dielectric constant of 2–5. The dielectric constant is determined by ASTM test method D150. The material of the outer casing member frame member 44*a* may be the above-described polystyrene resin material, acrylic nytril butadiene resin material, polybarbonate resin material or the like.

In such a unit 44, the substrate unit 44*b* provided with substrate 44*b*3 having the storing element 44*b*1, the communication antenna 44*b*2 and the sending circuit 44*b*11, is covered with the frame member 44*a*. Therefore, the storing element 44*b*1 can be protected from an external load or from an electrical influence. Since the substrate unit 44*b* is contained in the frame member 44*a* to constitute a tag-like member, the carrying space can be efficiently determined in the main assembly 14 or in the cartridge B. In addition, since it is constituted by three members, namely, the substrate unit 44*b*, the upper frame 44*a*1 and the lower frame 44*a*2, in the assembling operation is easy.

Second Embodiment

Figure 10:
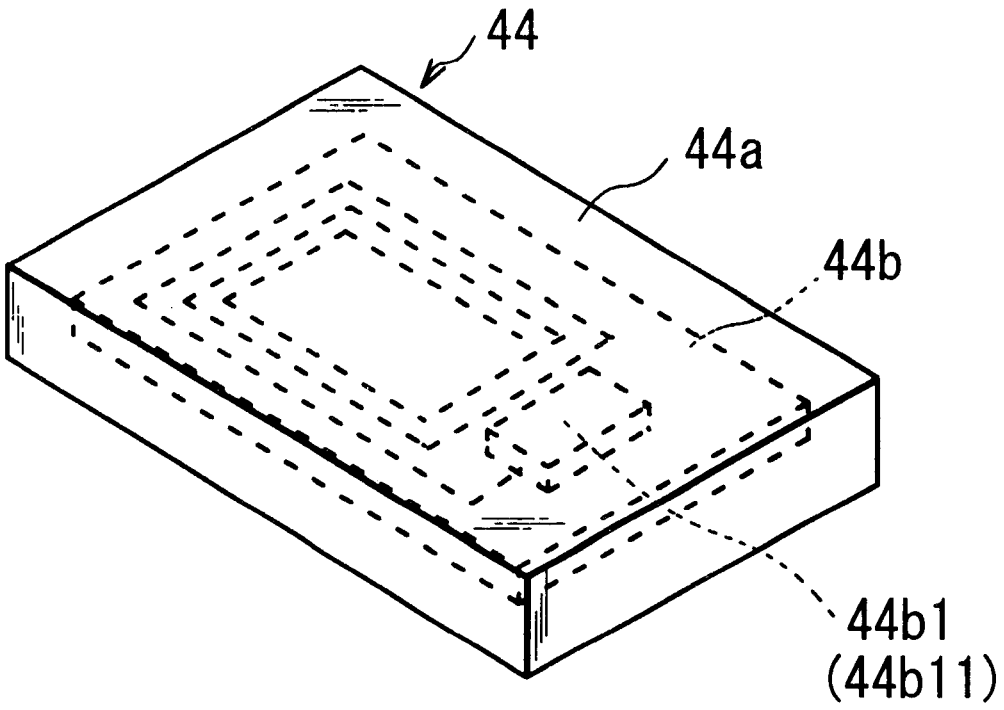
FIG. 10 is a perspective view after assembling of the memory unit shown in FIG. 9.

FIG. 10 is a perspective view of a memory unit according to a second embodiment of the present invention.

In this embodiment, the frame member 44*a* covering the unit 44*b* is produced through an injection molding of a resin material. More particularly, the memory unit 44 of this embodiment is produced by inserting a substrate unit 44*b* into a resin material mold and ejecting the resin material (insertion molding) with the inserted state.

In this case, the same advantageous effects as with the first embodiment can be provided.

Third Embodiment

Figure 11:
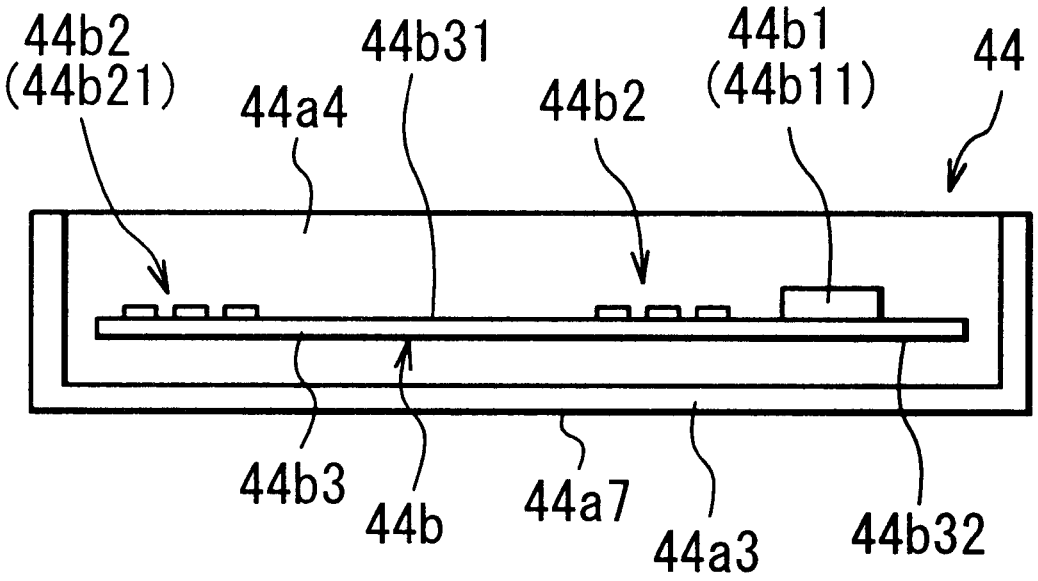
FIG. 11 is a sectional view of a memory unit shown in FIG. 9 according to another embodiment.

FIG. 11 is a sectional view of a memory unit according to a third embodiment of the present invention.

In this embodiment, the frame member outer casing member 44*a* covering the unit 44*b* is constituted by the resin material case 44*a*3 and a resin material or an elastomer 44*a*4 injected into the resin material case 44*a*3. In this embodiment, the unit 44 is produced by inserting the unit 44*b* into a resin material case 44*a*3 and injecting the elastomer 44*a*4 into the case 44*a*3 to fill it up.

With this structure, the unit 44 is advantageous similarly to the memory unit 44 in the first embodiment.

In the foregoing embodiments, the unit 44*b* is constituted by the storing element 44*b*1 provided with the sending circuit 44*b*11 and the communication antenna 44*b*2 which are disposed on the substrate 44*b*3 of the epoxy resin material. However, it is an alternative that they are disposed on different substrates, and they are connected by metal contacts or leads or the like.

The memory unit 44 in the foregoing Embodiments, there are provided a beveled portion 44*a*5 and a stepped portion 44*a*6 although they are not shown in the Figures.

The information stored in the storing element 44*b*1 are related with the process cartridge unit. For example, it is an integrated number of rotations of the photosensitive drum, the integrated charging time of the charging means, the remaining amount of the developer, or the like.

Memory Unit Structure 2

First Embodiment

Figure 12:
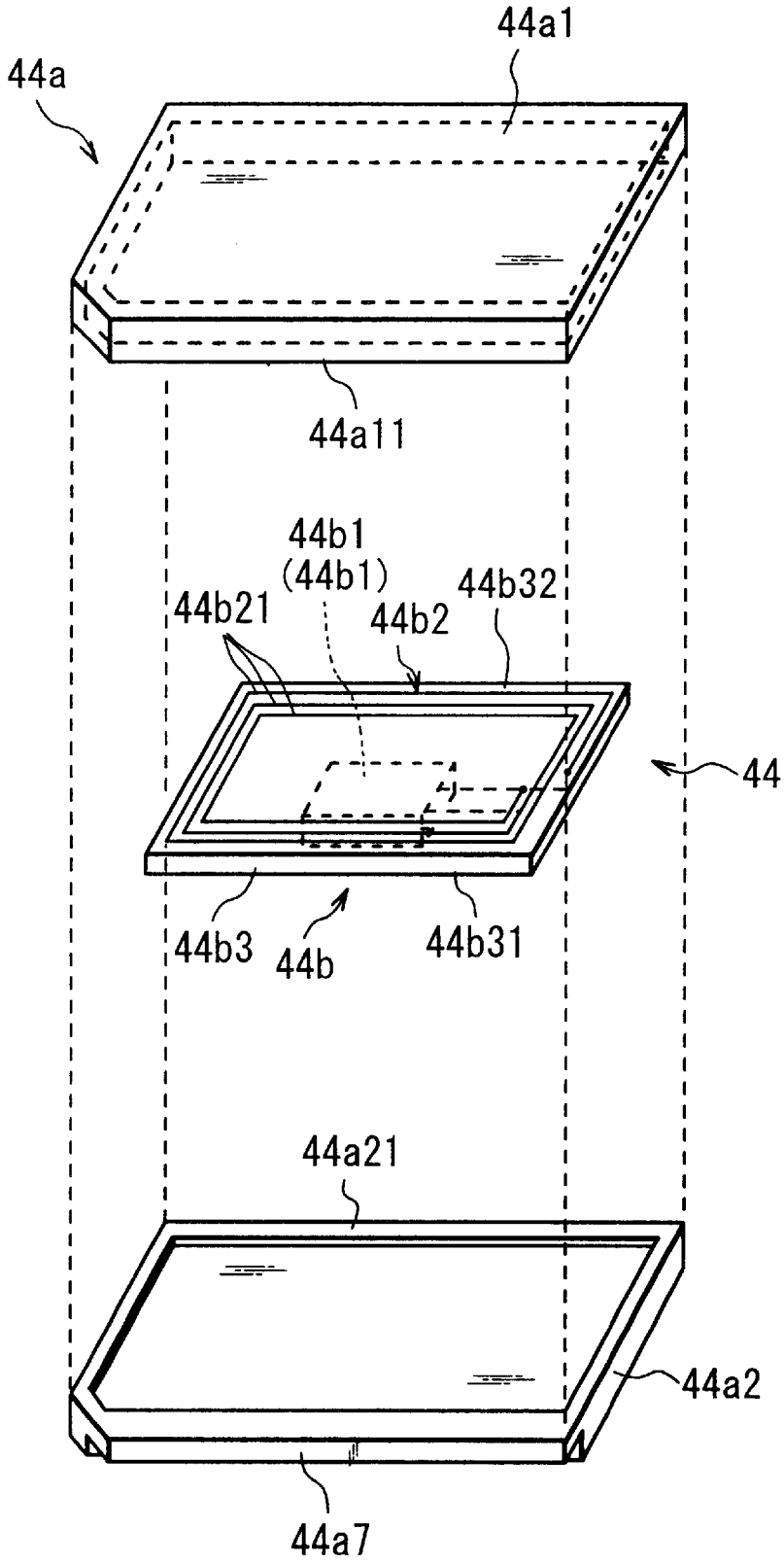
FIG. 12 is an exploded perspective view of a memory unit in which the storing element is distributed substantially at the center portion of the communication antenna on a back side of the substrate.
Figure 13:
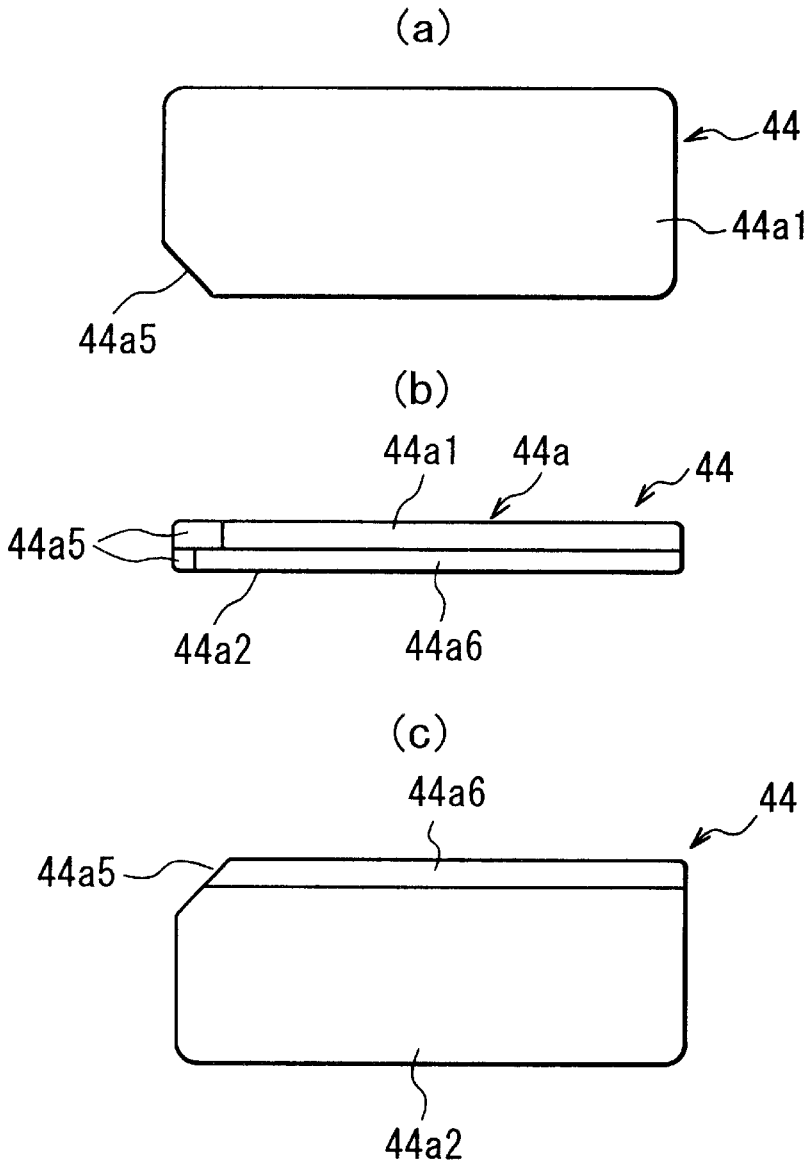
FIG. 13 shows a memory unit, wherein (a) is a top plan view; (b) is a front view; and (c) is a bottom view.
Figure 14:
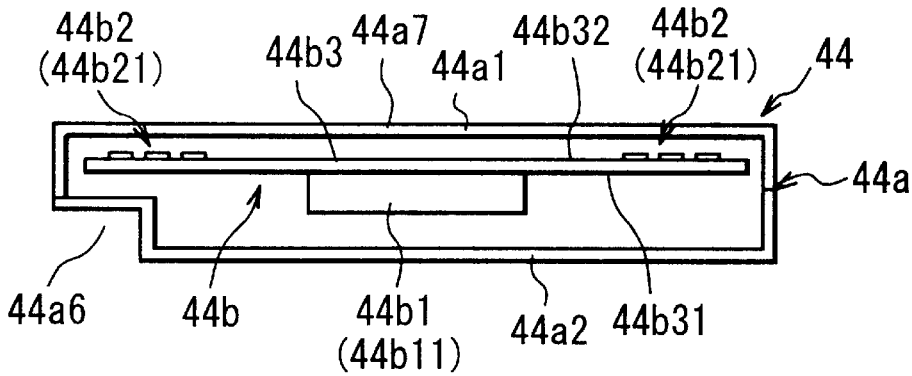
FIG. 14 is a sectional view of a memory unit shown in FIG. 12.

In the foregoing embodiments, the memory unit 44 has the unit 44*b* in which the storing element 44*b*1 is disposed outside the antenna 44*b*2. In this embodiment, the memory unit has a substrate unit in which the storing element is disposed inside the antenna. FIG. 12 is an exploded perspective view of a memory unit according to this embodiment of the present invention. FIG. 13 is an outer appearance of the memory unit shown in FIG. 12, an is a top plan view of the memory unit, b is a front view of the memory unit, and c is a bottom view of the memory unit. FIG. 14 is a sectional view of the memory unit shown in FIG. 12. The same reference numerals as with the foregoing memory unit are assigned to the corresponding elements.

As shown in FIGS. 12 and 13, the unit 44 of this embodiment is in the form of a tag comprising a substrate unit 44*b* and a frame member 44*a* as an outer casing member covering the substrate unit 44*b*. The substrate unit 44*b* includes a storing element 44*b*1 for storing information, an antenna 44*b*2 magnetic core as a memory antenna) for communication and a substrate 44*b*3 for carrying the storing element 44*b*1 and the communication antenna 44*b*2, as a unit. The storing element 44*b*1 is provided on a rectangular substrate 44*b*3 made of epoxy resin material. More particularly, the storing element 44*b*1 is provided on a back side 44*b*31 of the substrate 44*b*3 (the side opposite from the side which is faced to the antenna unit 41 provided in the main assembly 14 of the apparatus), and is disposed inside a conduction pattern 44*b*21 constituting the antenna 44*b*2. More particularly, it is provided inside the pattern 44*b*21 substantially at the center portion of the back side of the substrate 44*b*3. The storing element 44*b*1 comprises a FERAM. The storing element 44*b*1 is integral with the sending circuit 44*b*11 functioning as the sending member shown in FIG. 15. The antenna 44*b*2 is provided on a surface 44*b*31 the side faced to the antenna unit 41 provided in the main assembly 14 of the apparatus) of the substrate 44*b*3. The antenna 44*b*2 has a pattern 44*b*21 in the form of a volute extended along the sides of the rectangular shape of the substrate 44*b*3. The pattern 44*b*21 is formed on the substrate 44*b*3 by pattern printing. The pattern 44*b*21 is connected with a storing element 44*b*1 FERAM. The unit 44*b* thus constructed is disposed in the frame member 44*a*. The frame member 44*a* comprises an upper outer casing portion (upper frame 44*a*1) made of polystyrene resin material and a lower outer casing portion (lower frame 44*a*2). The upper frame 44*a*1 and the lower frame 44*a*2 are provided with projected portions 44*a*11, 44*a*21 at the circumference thereof. The projected portions 44*a*11, 44*a*21 of the upper frame 44*a*1 and the lower frame 44*a*2 are contacted to each other to constitute a frame member 44*a*.

The projected portions 44*a*11, 44*a*21 of the upper frame 44*a*1 and the lower frame 44*a*2 are fixed by an adhesive material, welding, ultrasonic welding or the like after the unit 44*b* is inserted. More particularly, the frame member 44*a* is made of a material having a dielectric constant of 2–5. The material of the non-electroconductive member may be the above-described polystyrene resin material, acrylic nytril butadiene resin material, polybarbonate resin material or the like.

Figure 15:
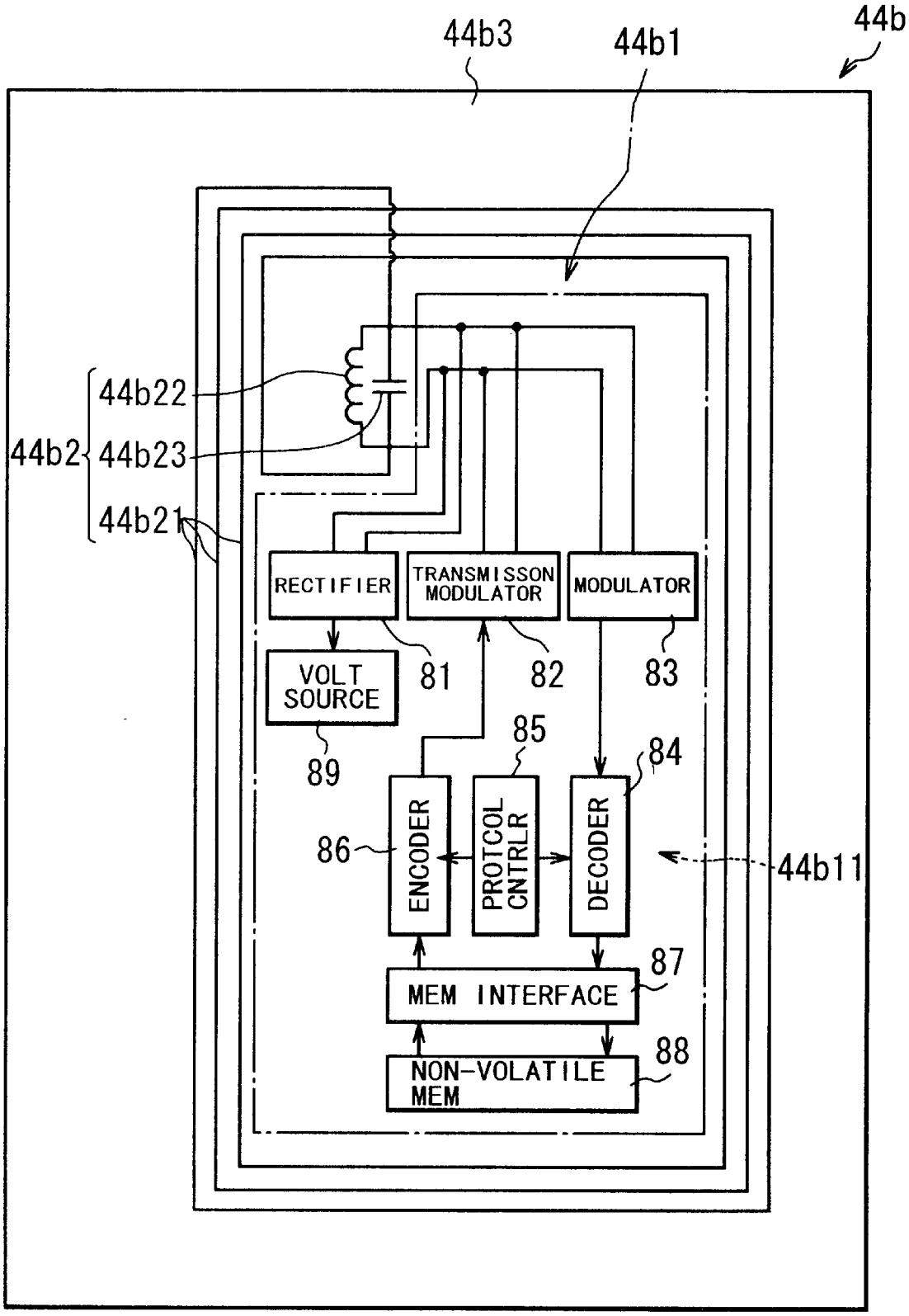
FIG. 15 shows an electric circuit Figure of the storing element.

Referring to FIG. 15, the description will be made as to the inner structure of the storing element 44*b*1.

FIG. 15 shows a circuit of a storing element. As shown in FIG. 15, the storing element 44*b*1 is formed integrally with a sending circuit 44*b*11 provided on the substrate 44*b*3. The circuit 44*b*11 functions to supply the information stored in the storing element 44*b*1 to the antenna 44*b*2. The antenna 44*b*2 comprises a coil 44*b*22, a capacitor 44*b*23 and an electroconductive pattern 44*b*21 in the form of a volute. To the antenna 44*b*2, there are connected a rectifying circuit 81 of the sending circuit 44*b*11, a sending modulation circuit 82 and a demodulation device 82. The output of the rectifying circuit 81 is connected to the voltage source circuit 81 to supply the electric energy to a non-volatile memory 88. It further comprises a decoder 84, a protcol controller 85, an encoder 86, a memory interface, a non-volatile memory 88 such as an EEPROM or a strong dielectric member memory. When the signal is demodulated from a high frequency signal to a base band signal by the demodulation device 83, it is converted to a signal proper for supply to the memory 88 in accordance with a control of the protcol controller 85 by the decoder 84. The circuit 87 classifies the signal into the address and the data, the reading and writing is carried out to and from the memory 88 in accordance with a read/write command. The data read out of the memory 88 is send from the circuit 87 to the encoder 86, and is converted to protcol proper to the communication, and then it is sent from the sending modulation circuit 8252 to the antenna 44*b*2.

With the structure of the memory unit 44, when the unit 44 is a busted to the antenna unit 41 provided in the main assembly 14 of the apparatus through a boss 13*h* (13*m*) which will be described hereinafter, the antenna 44*b*2 of the unit 44*b* can be properly faced to the unit 41. Therefore, the distance between the antenna 41*c* and the antenna 44*b*2 can be minimized. Therefore, the distance between the antenna 41*c* and the antenna 44*b*2 can be minimized. Because of this, the level of the output of the antenna unit 41 provided in the main assembly 14 of the apparatus can be minimized.

In addition, the wireless communication distance between the antenna 41*c* and the antenna 44*b*2 can be minimized. Therefore, the wireless communication is substantially free of external disturbance such as noise, and therefore, the reliability in the communication is improved.

For example, in this embodiment, the distance between the antenna 41*c* (main assembly antenna) and the antenna 44*b*2 memory antenna can be maintained at 1.75 mm–3.25 mm. The distance is merely an example, and the distance between the antennas 41*c*, 44*b*2 may practically be 1 mm–10 mm.

The storing element 44*b*1 is disposed inside the antenna 44*b*2. Therefore, the area of the unit 44*b* can be reduced. For this reason, the memory unit 44 can be downsized.

The unit 44*b* is covered with the frame member 44*a*. Therefore, the same advantageous effects as with the foregoing memory unit 44 can be provided in addition to the above-described advantageous effects.

Second Embodiment

Figure 16:
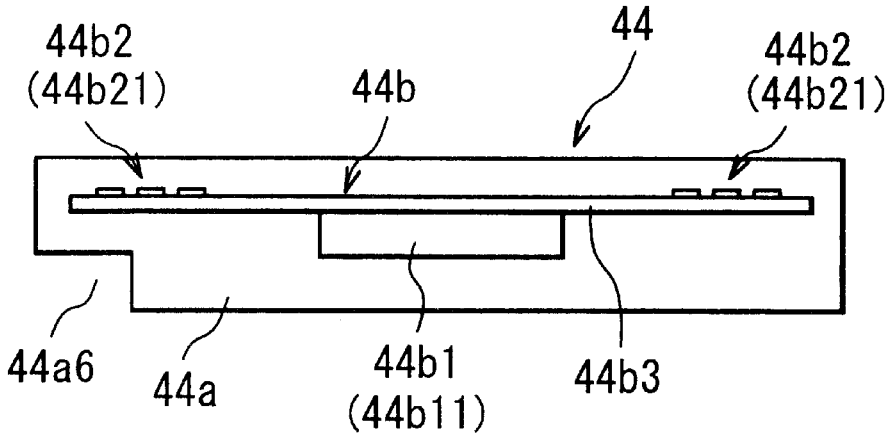

FIG. 16 is a perspective view of a memory unit according to a second embodiment of the present invention.

In this embodiment, the frame member 44*a* covering the substrate unit 44*b* is produced from a resin material by an injection molding. More particularly, the unit 44 is produced by inserting the unit 44*b* into a mold of the resin material and ejecting the resin material in this state.

In this case, the same advantageous effects as with the first embodiment can be provided.

Third Embodiment

Figure 17:
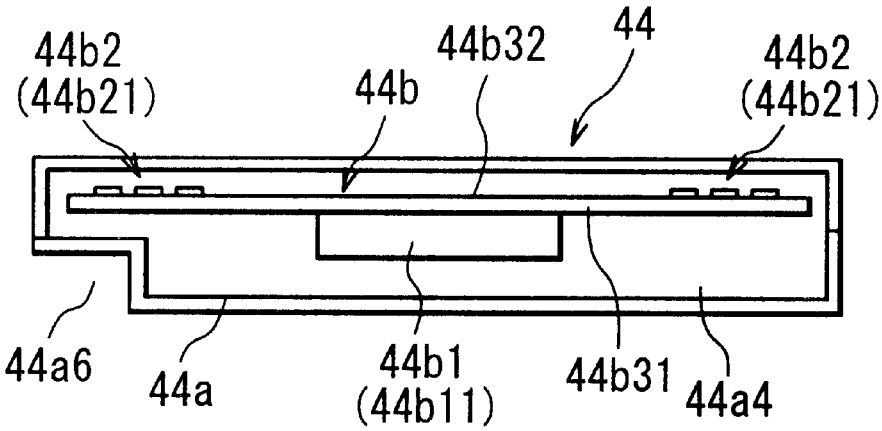
FIG. 17 is a sectional view of a memory unit shown in FIG. 12 according to a further embodiment of the present invention.

FIG. 17 is a sectional view of a memory unit according to a third embodiment of the present invention.

In this embodiment, a frame member 44*a* covering a substrate unit 44*b* is constituted by a resin material case 44*a*3, resin material injected in the resin material case 44*a*3 and an elastomer 44*a*4. In this embodiment, the unit 44 is produced by inserting the unit 44*b* into a resin material case 44*a*3 and injecting the elastomer 44*a*4 into the case 44*a*3 to fill it up.

In this case, the same advantageous effects as with the first embodiment can be provided.

In the foregoing embodiments, the substrate unit 44*b* comprises the storing element 44*b*1 having the circuit 44*b*11 and the antenna 44*b*2 which are disposed on the substrate 44*b*3 of epoxy resin material. However, it is an alternative that they are disposed on different substrates, and they are connected by metal contacts or leads or the like.

Fourth Embodiment

Figure 18:
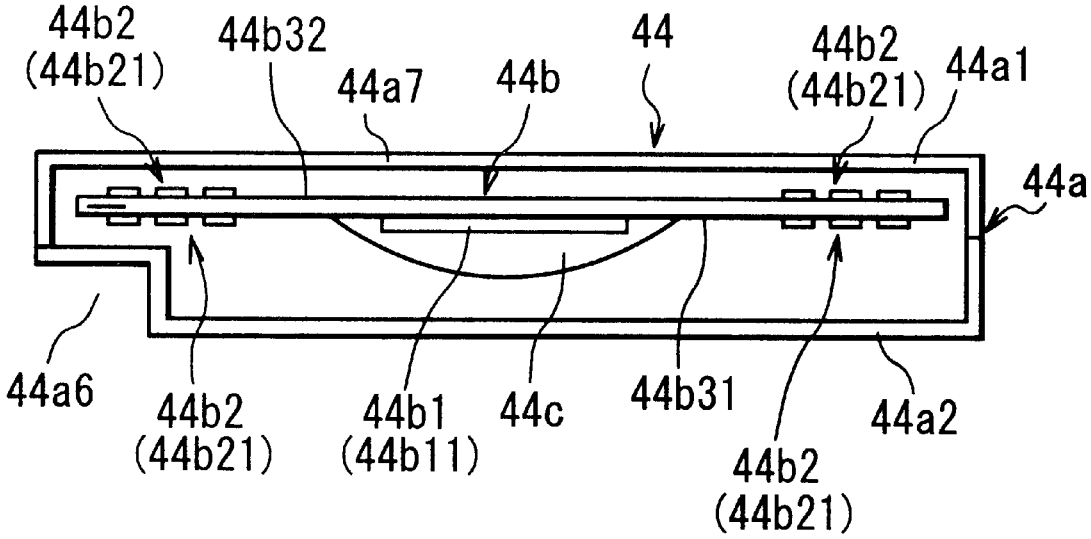
FIG. 18 is a perspective view of a memory unit provided with a beveled portion and a stepped portion.

In the foregoing abutments, the communication antenna 44*b*2 is provided only on the back side 44*b*31 of the substrate 44*b*3. In this embodiment, the memory unit memory member has a substrate unit in which a communication antenna is extended on both of the front and back sides of the substrate. FIG. 18 is a sectional view of a memory unit according to this embodiment of the present invention. The same reference numerals as with the memory unit of the first embodiment are assigned to the element having the corresponding functions.

Figure 19:
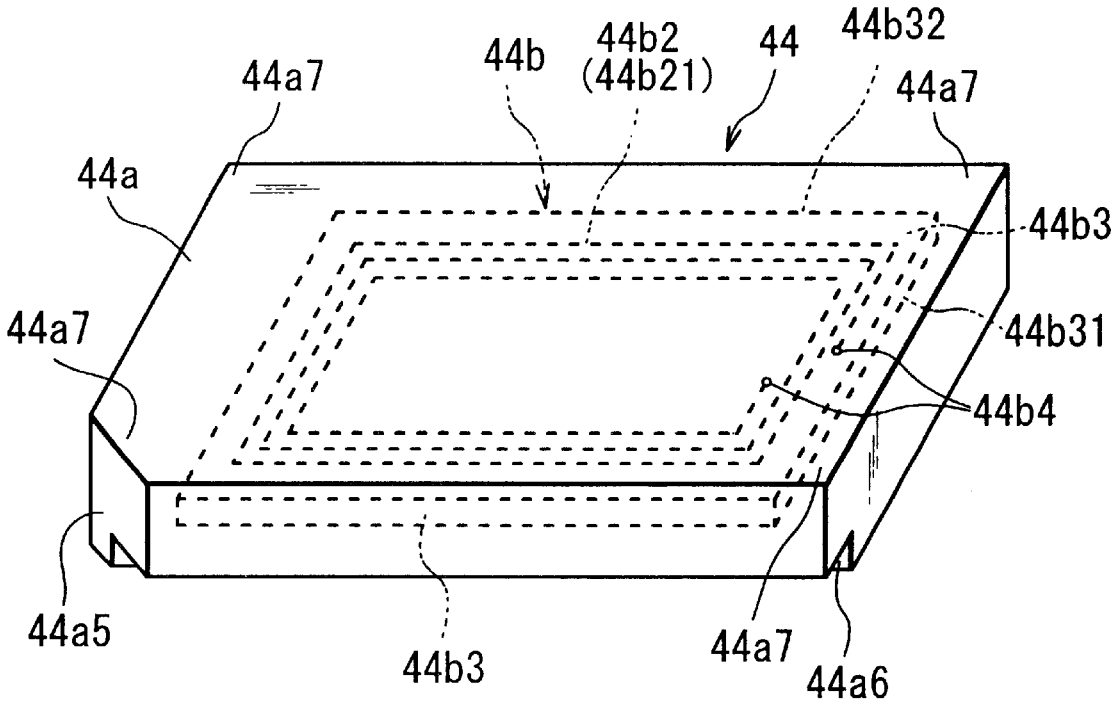
FIG. 19 is an illustration of a mounting portion provided in the process cartridge.

As shown in FIG. 18, the memory unit 44 of this embodiment comprises an electroconductive pattern 44*b*21 of the antenna 44*b*2 on the front surface 44*b*32 of the substrate 44*b*3 the surface to be faced to the antenna unit 41 of the main assembly 14 of the apparatus and on a back side 44*b*31 the surface opposite from the front surface to be opposed to the antenna unit 41, namely, the surface having the storing element 44*b*1. More particularly, as shown in FIG. 19, the electroconductive pattern 44*b*21 of the antenna 44*b*2 is penetrated to the surface 44*b*32 of the substrate 44*b*3, and then through the substrate 44*b*3 to the back side 44*b*31 of the base 44*b*3. Then, it penetrates the back side 44*b*31 of the substrate 44*b*3 and then the substrate 44*b*3 back to the surface 44*b*32 of the substrate 44*b*3. Designated by reference numeral 44*b*4 is a hole for passing it, and is provided in the substrate 44*b*3. Through the hole 44*b*4, the electroconductive pattern 44*b*21 is electrically connected between the surface 44*b*32 side and the back side 44*b*31 side. One and the other ends of the electroconductive pattern 44*b*21 are electrically connected with the sending circuit 44*b*11 of the storing element 44*b*1. The pattern 44*b*21 is in the form of a volute extended along sides of the rectangular shape of the substrate 44*b*3 similarly to first embodiment. The storing element 44*b*1 is covered with and protected by a bonding 44*c* of a resin material on the substrate 44*b*3. In a manufacturing step of the substrate unit 44*b* or in a memory unit assembling step of assembling the upper frame 44*a*1, the lower frame 44*a*2 and the substrate unit 44*b*, the storing element 44*b*1 can be protected from external forces thereto. With this structure of the unit 44, similarly to the unit 44 of the first embodiment, when the unit 44 is abutted to the antenna unit 41 provided in the main assembly 14 of the apparatus, the antenna 44*b*2 in the substrate unit 44*b* can be faced to the antenna unit 41. Therefore, the distance between the antenna 41*c* (main assembly antenna) and the antenna 44*b*2 (memory antenna) can be minimized. In this embodiment, the distance between the antennas 41*c*, 44*b*2 is 1.75 mm–3.25 mm. This is effective to minimize the output of the antenna unit 41 provided in the main assembly 14 of the apparatus for the wireless communication. The minimization of the communication distance between the antenna 41*c* and the antenna 44*b*2 is effective to make the communication substantially free of external disturbances such as noise. Therefore, the reliability of the wireless communication can be improved. Additionally, the wireless communication is possible between the antenna 41*c* and the antenna 44*b*2 provided on both of the surface 44*b*32 and the back side 44*b*31 of the substrate 44*b*3, and this is effective to further improve the reliability of the wireless communication. By the provision of the antenna 44*b*2 on both of the front and back sides of the substrate 44*b*3, the number of windings of the antenna 44*b*2 can be increased. By doing so, the output of the antenna 44*b*2, that is, the intensity of the electromagnetic field can be enhanced.

The storing element 44*b*1 is disposed inside the antenna 44*b*2 on the substrate 44*b*3. This is effective to reduce the area of the substrate unit 44*b*. For this reason, the memory unit 44 can be downsized.

The substrate unit 44*b* is covered with a frame member 44*a*. Therefore, the same advantageous effects as with the foregoing memory unit 44 can be provided in addition to the above-described advantageous effects.

Memory Unit Mounting Structure

Figure 20:
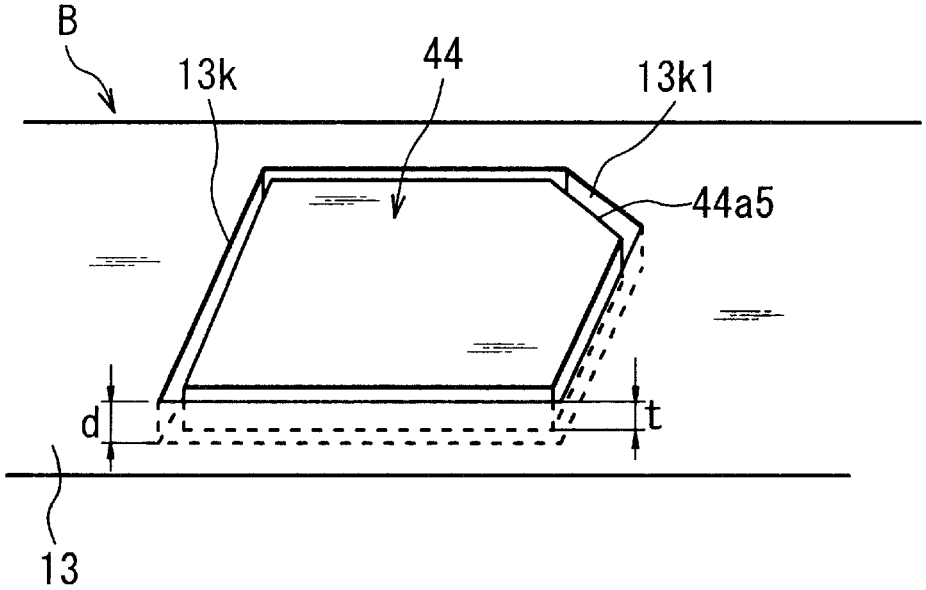
FIG. 20 is an illustration of a feeding guide for the memory unit.

Referring to FIGS. 19, 20, the description will be made as to a memory unit mounting structure.

FIG. 19 is a perspective view of a memory unit which is provided with a beveled portion and a stepped portion. FIG. 20 illustrates a memory unit mounting portion in the cartridge side.

When the memory unit 41 is mounted on a frame, it is desirable to provide a means to prevent the memory unit 41 from being mounted upside down or the memory unit 44 from being mounted in a wrong orientation. When the memory unit 41 is mounted upside down, the distance between the antenna 41*c* and the antenna 44*b*2 are different from the predetermined distance with the result of deterioration of the reliability in the communication. When the mounting orientation of the memory unit 44 is wrong, the correct facing between the antenna 41*c* and the antenna 44*b*2 is not accomplished with a result of deterioration of the reliability in the communication, again.

In order to assure the reliability of the communication between the antenna 41*c* and the antenna 44*b*2, it is desirable that facing orientation of the memory unit 44 and the facing position are regulated.

In this embodiment, means are provided to determine the facing orientation and the facing position of the memory unit 44 relative to the antenna 41*c*. As shown in FIG. 19, a beveled portions 44*a*5 functioning as a regulating portion is provided at one of the corner portions 44*a*7 at the outer periphery of the frame member 44*a* of the memory unit 44. The beveled portion 44*a*5 is effective to regulate the mounting position or orientation of the memory member when it is mounted. As shown in FIGS. 1 to 4, the memory unit 44 is mounted to the cleaning unit C. As shown in FIG. 20, the cleaner frame 13 of the cleaning unit C is provided with a memory unit mounting portion 13*k* for detachably mounting the unit 44. The memory unit mounting is provided at a position in which the memory unit 44 is faced to the antenna unit 41 in the inserting direction of the cartridge B. The memory unit mounting portion 13*k* is provided at a leading end portion of the cleaner frame 13 with respect to the cartridge mounting direction. The mounting portion 13*k* is provided with a beveled portion 13*k*1 functioning as a main assembly side regulating portion, at one of the inner corner portions. More particularly, it is substantially the same as the memory unit 44 in shape. The beveled portion 13*k*1 provided in the memory unit mounting portion 13*k* is complementary with the beveled portion 44*a*5 provided in one of the corner portions of the memory unit 44.

When the memory unit 44 is mounted to the memory unit mounting portion 13*k*, it is fitted into the memory unit mounting with the beveled portions 44*a*5, 13*k*1 aligned with each other in the mounting direction of the memory unit 44. By doing so, the facing orientation of the memory unit 44 relative to the communication antenna 41*c* or the facing position can be regulated. By doing so, an erroneous facing orientation of the memory unit 44 can be avoided during the mounting operation. In addition, erroneous mounting direction of the memory unit 44 does not occur during the mounting operation. A depth of the mounting portion 13*k* is substantially the same as the thickness of the unit 44.

Assembling Method of Memory Unit and Feeding Guide Structure

The description will be made as to mounting of the memory unit 44 to the cleaning unit C using an automatic assembling apparatus unshown. In this case, a parts feeder may be used to align the unit 44. In the parts feeder, a great number of units 44 are carried on a supporting table, and the supporting table is vibrated to move the units while making them direct uniformly, and then feeding the units 44 to the finger portion of the automatic assembling apparatus. In this embodiment, the units 44 can be supplied to the automatic assembling apparatus using the parts feeder. To accomplished this, as shown in FIG. 19, the back side of the unit 44 is provided with a stepped portion 44*a*6 which functions as a guide portion (feeding guide). Here, the back side of the memory unit 44 is the surface opposite from the side to be faced to the antenna unit 41 provided in the main assembly 14 of the apparatus when the unit 44 is mounted to the main assembly 14 of the apparatus. The stepped portion 44*a*6 is provided along one of the long sides of the unit 44 and is extended in the longitudinal direction of the unit 44. In other words, it is provided on an outer surface of the unit 44 having a substantially rectangular parallelopiped configuration and is extended in the longitudinal direction as shown in FIGS. 13, 14, 16–19 and 21, 22.

Figure 21:
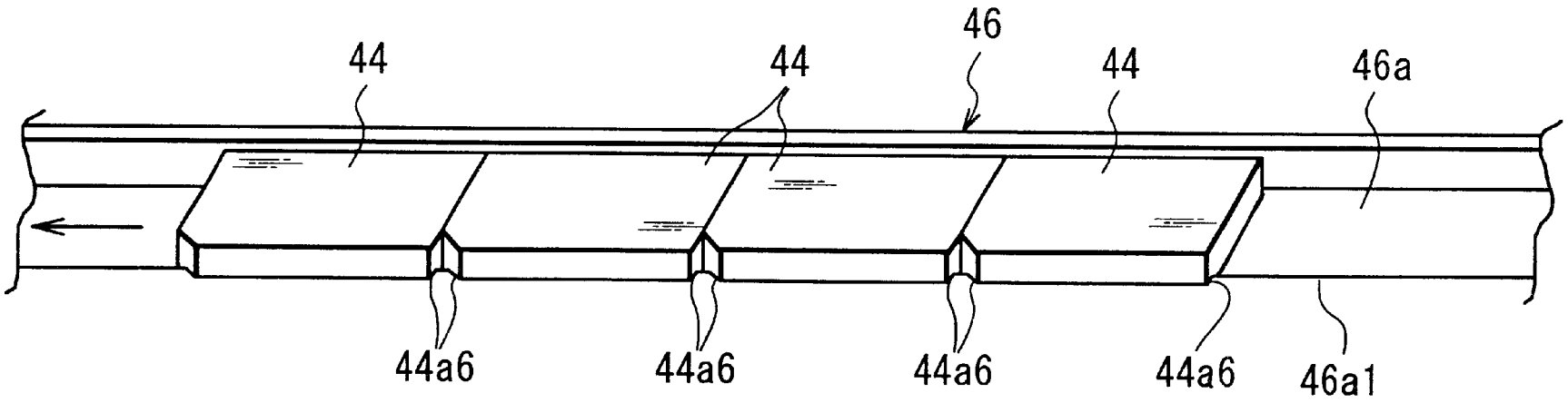
FIG. 21 is an illustration of a feeding type of a memory unit in a parts feeder.

FIG. 21 shows an example of the parts feeder for feeding the memory unit. FIG. 22 is a sectional view of a feeding guide of the parts feeder. As shown in FIG. 21, the parts feeder 46 comprises a feeding guide 46*a* which is in the form of a supporting table for carrying and moving a number of memory unit 44 by imparting vibration or the like. The feeding guide 46*a* is channel-shaped for guiding the outer surface of the unit 44 in the longitudinal direction FIG. 22. The side of the feeding guide 46*a* which is faced to the bottom surface side of the unit 44, is provided with a guide stepped portion 46*a*1 which is extended in the longitudinal direction correspondingly to the stepped portion 44*a*6. The guide stepped portion 46*a*1 is shaped such that when the unit 44 is on the feeding guide 46*a* with the back side thereof facing down, the guide stepped portion 46*a*1 supports the stepped portion 44*a*6 of the unit 44.

When the units 44 are supplied to the automatic assembling apparatus by the feeder 46, the units 44 are placed on the guide 46*a* of the feeder 46 with the back side thereof facing down, so that stepped portion 44*a*6 is supported by the guide stepped portion 46*a*1 FIG. 22. By doing so, the directions of the memory units 44 and the facing orientations thereof are correctly determined. Therefore, as shown in FIG. 21, the units 44 can be supplied properly to the automatic assembling apparatus along the guide 46*a*. Thus, by the provision of the stepped portion 44*a*6 at one side of the unit 44, the directions of the unit 44 and the facing orientations can be properly controlled.

Thus, the automatic assembling can be accomplished.

II. Disposition of Memory Unit

As shown in FIGS. 3 and 4, the memory unit 44 is mounted on the cleaning unit C. The wireless communication is carried out while it is abutted to the antenna unit 41 provided in the main assembly 14 of the apparatus. The unit 44 is mounted by a double coated tape, an adhesive material, heat crimping, ultrasonic welding, snap fit or the like such that it can be easily demounted from the cartridge B. The mounting of the unit 44 is strong enough to avoid unintended demounting, when the user touches the unit 44, or when the cartridge B is mounted to the main assembly 14 of the apparatus.

Memory Unit Mounting Structure (Center Portion Disposition of Memory Unit)

When the wireless communication is carried out with the memory unit 44 abutted to the antenna unit 41 provided in the main assembly 14 of the apparatus, it is desirable that position is such that wireless communication is not easily influenced by radio wave from another electronic equipment (CRT or the like) placed in the neighborhood of the image forming apparatus A.

As shown in FIGS. 3 and 4, the memory unit 44 is disposed substantially at the center of the cleaning unit C (cartridge frame) in the longitudinal direction of the cartridge B (the axial direction of the photosensitive drum 7). When the cartridge B is inserted into the main assembly 14 of the apparatus, the unit 44 is abutted to the antenna unit 41 in the neighborhood of the center of the main assembly 14 of the apparatus, and the communication is carried out in this position FIG. 1. In other words, by mounting the unit 44 substantially at the center portion of the unit C in the longitudinal direction of the cartridge B, it is disposed at a position most remote from the outer casing surface of the main assembly 14 of the apparatus. As a result, even if another electronic equipment is placed in the neighborhood of the image forming apparatus A, the wireless communication is not easily influenced by the electronic equipment, thus minimizing the influence of the radio wave.

The unit 44 is substantially at the center of the unit C in the longitudinal direction of the cartridge B. Therefore, when the unit 44 is abutted to the unit 41, the cartridge B can be smoothly inserted. More particularly, when the unit 44 is contacted to the unit 41, or when the cartridge B is inserted into the main assembly 14 of the apparatus, the resistance against insertion is uniform in the longitudinal direction of the cartridge B. Therefore, the cartridge B can be smoothly mounted.

Structure of the Memory Unit Mounting Portion

Referring to FIGS. 23–28, the structure of the mounting portion of the memory unit 44 will be described.

In order to recycle the cleaner frame 13 of the cartridge B (container recycling or material recycling), it is desirable that unit 44 is dismounted without damage to the cleaner frame 13. This is because if the memory unit 44 containing the substrate unit 44*b* comprising the electrical part, the container recycling or the material recycling of the cleaner frame 13 made of a resin material is difficult.

In view of this, in this embodiment, the memory unit mounting portion 13*k* is so constructed that memory unit 44 can be easily dismounted. In addition, the structure is such that unit 44 can be easily dismounted from the mounting portion 13*k*. The unit 44 is demountably mounted to the cleaner frame 13. These embodiments will be described.

First Embodiment

As shown in FIG. 23, the mounting portion 13*k* is provided on an inner surface faced to a side surface of the unit 44 with an inclined surface 13*l* tool inserting portion for permitting insertion of a tool. The inclined surface 13*l* is expanded toward an inlet of the mounting portion 13*k* from a bottom surface of the mounting portion 13*k*. With this structure, the unit 44 can be easily dismounted from the inclined surface 13*l*. The unit 44 is mounted on the bottom surface of the mounting portion 13*k* by a double coated tape (bonding member). The memory unit 44 may be dismounted by a minus type screwdriver, for example. The mounting operation, the end of the minus type screwdriver is inserted between the bottom surface of the mounting portion 13*k* and the back side of the unit 44 along the inclined surface 13*l* of the mounting portion 13*k*, so that unit 44 is raised from the mounting portion 13*k*.

Thus, the unit 44 is dismounted from the cleaner frame 13. In order to prevent direct contact of the unit 44 to something during transportation and/or due to unintentional dropping upon mounting-and-demounting of the cartridge B, the surface of the unit 44 is stepped down from the surface of the cleaner frame 13, or the cleaner frame 13 is made to cover a part of the surface of the unit 44.

Second Embodiment

As shown in FIG. 24 an and b, the recess functioning as a mounting portion 13*k*, has a size slightly larger than that of the unit 44. By doing so, there is provided a gap between the inner surface of the mounting portion 13*k* and the outer surface of the unit 44.

A width 13*m* of the bottom surface on which the memory unit 44 is fixed is made a smaller than the width 13*n* of the memory unit 44. By this, a tool inserting portion 13*u* in the form of a groove portion is provided to the insertion of the tool, around the bottom surface. The unit 44 is mounted on the bottom surface of the mounting portion 13*k* by a double coated tape. In the demounting operation, the end of the minus type screwdriver tool is inserted into the portion 13*u* of the mounting portion 13*k*, and the unit 44 is raise from the bottom surface of the mounting portion 13*k* using a lever function.

By doing so, the unit 44 is dismounted from the cleaner frame 13.

As shown in FIG. 25 an and b, the mounting portion 13*k* is provided with a recesses 13*v* (stepped portion) tool inserting portion in order to permit insertion of the tool to a part of the inner surface opposed to the opposite ends of the unit 44. The recesses 13*v* is formed toward the cleaner frame 13. The unit 44 is mounted on the bottom surface of the mounting portion 13*k* by a double coated tape. In the demounting operation, the end of the minus type screwdriver tool is inserted into recess 13*v*, and the unit 44 is raised from the bottom surface of the mounting portion 13*k* using a lever function. By doing so, the unit 44 is dismounted from the cleaner frame 13.

Figure 26:
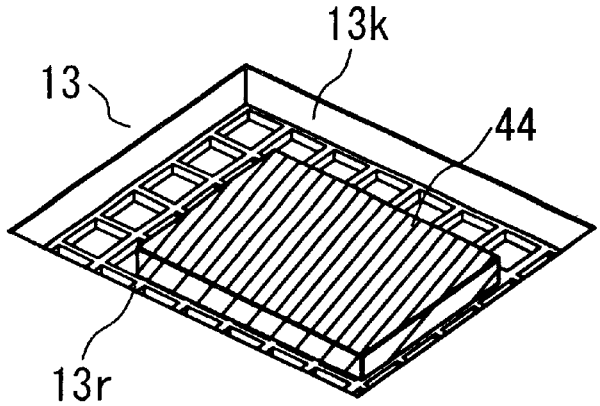
FIG. 26 is an illustration of a memory unit mounting portion having a tool inserting portion according to a fourth embodiment of the present invention.

As shown in FIG. 26, the mounting portion 13*k* is provided with a rib 13*r* tool inserting portion to permit insertion of the tool to the bottom surface faced to back side of the unit 44. The rib 13*r* is projected from the bottom surface of the mounting portion 13*k*, and forms a grid-like pattern. By the provision of such a grid-like pattern, the contact area relative to the unit 44 can be made smaller, thus accomplishing easy demounting of the unit 44. The unit 44 is mounted on the grid-like rib 13*r* of the mounting portion 13*k* by a double coated tape. In the demounting operation, the minus type screwdriver tool is inserted into the space between the portions of the rib 13*r* to which the unit 44 is mounted, and the unit 44 is raised from the bottom surface of the mounting portion 13*k* using a lever function. Thus, the unit 44 is dismounted from the cleaner frame 13.

Third Embodiment

Figure 27:
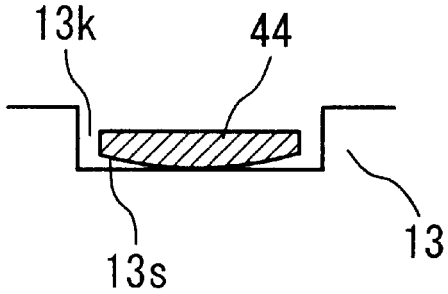
FIG. 27 is an illustration of a memory unit having a tool inserting portion.
Figure 28:
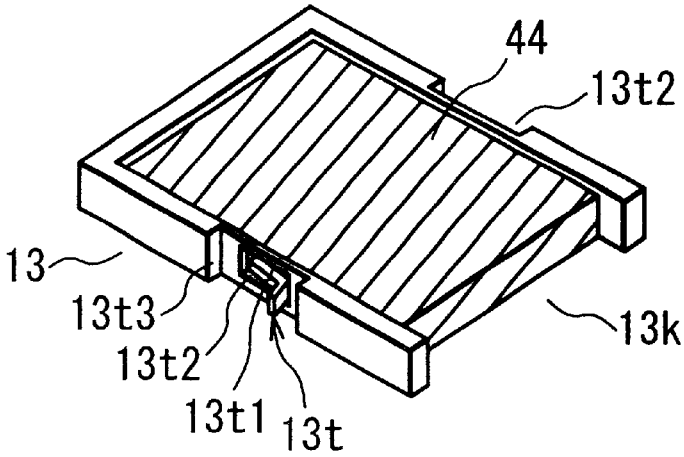
FIG. 28 is an illustration of a snap fitting for mounting the memory unit to the cleaner frame.

In this embodiment, the memory unit is provided with means. FIG. 27 shows a memory unit according to this embodiment of the present invention. As shown in FIG. 27, the memory unit 44 is provided with an inclined portion 13*s* tool inserting portion to permit insertion of a tool to a corner portion at the bottom side of the mounting portion 13*k* provided in the cleaner frame 13. The inclined portion 13*s* is beveled. The unit 44 is mounted on the bottom surface of the mounting portion 13*k* by a double coated tape.

In the demounting operation, an end of the minus type screwdriver tool is inserted to the inclined portion 13*s*, and the unit 44 is raised from the bottom surface of the mounting portion 13*k* using a lever function. Thus, the unit 44 is dismounted from the cleaner frame 13.

Fourth Embodiment

In this embodiment, the memory unit 44 is detachably mountable on the cleaner frame 13. FIG. 27 shows a structure of a memory unit mounting portion using the snap-fit. The memory unit 44 is provided with a snap 13*t*1 in the form of an elastic segment constituting a part of the snap fitting 13*t* structure. The cleaner frame 13 is provided with the mounting portion 13*k*, a locking hole 13*t*2 which is a locking portion structuring a part of the snap fitting 13*t*, and an insertion groove (tool inserting portion) 13*t*3 for permitting a screwdriver tool for the purpose of this engaging the snap 13*t*1 from the locking hole 13*t*2. When the unit 44 mounted to the cleaner frame 13, the unit 44 is engaged into the mounting portion 13*k* to bring the snap 13*t*1 into engagement with the locking hole 13*t*2. When the unit 44 is dismounted from the cleaner frame 13, an end of the screwdriver is inserted into the groove 13*t*3 to press the snap 13*t*1 locked with the locking hole 13*t*2 to release the engagement with the locking hole 13*t*2. By doing so, the unit 44 can be dismounted from the cleaner frame 13.

Fifth Embodiment

The mounting of the memory unit 44 to the cleaner frame 13 is not limited to the use of the double coated tape. For example, an adhesive material, heat crimping, ultrasonic welding or the like are usable. What is required is that unit 44 is easily dismounted from the mounting portion 13*k* of the cleaner frame 13 using a tool or another.

Using the structure shown in FIGS. 23–28, the memory unit 44 can be dismounted without damage to the cleaning frame 13. Thus, the container recycling and/or material recycling of the cleaner frame 13, namely, recycling thereof is enabled.

Structure for Protection of Memory Unit

Figure 29:
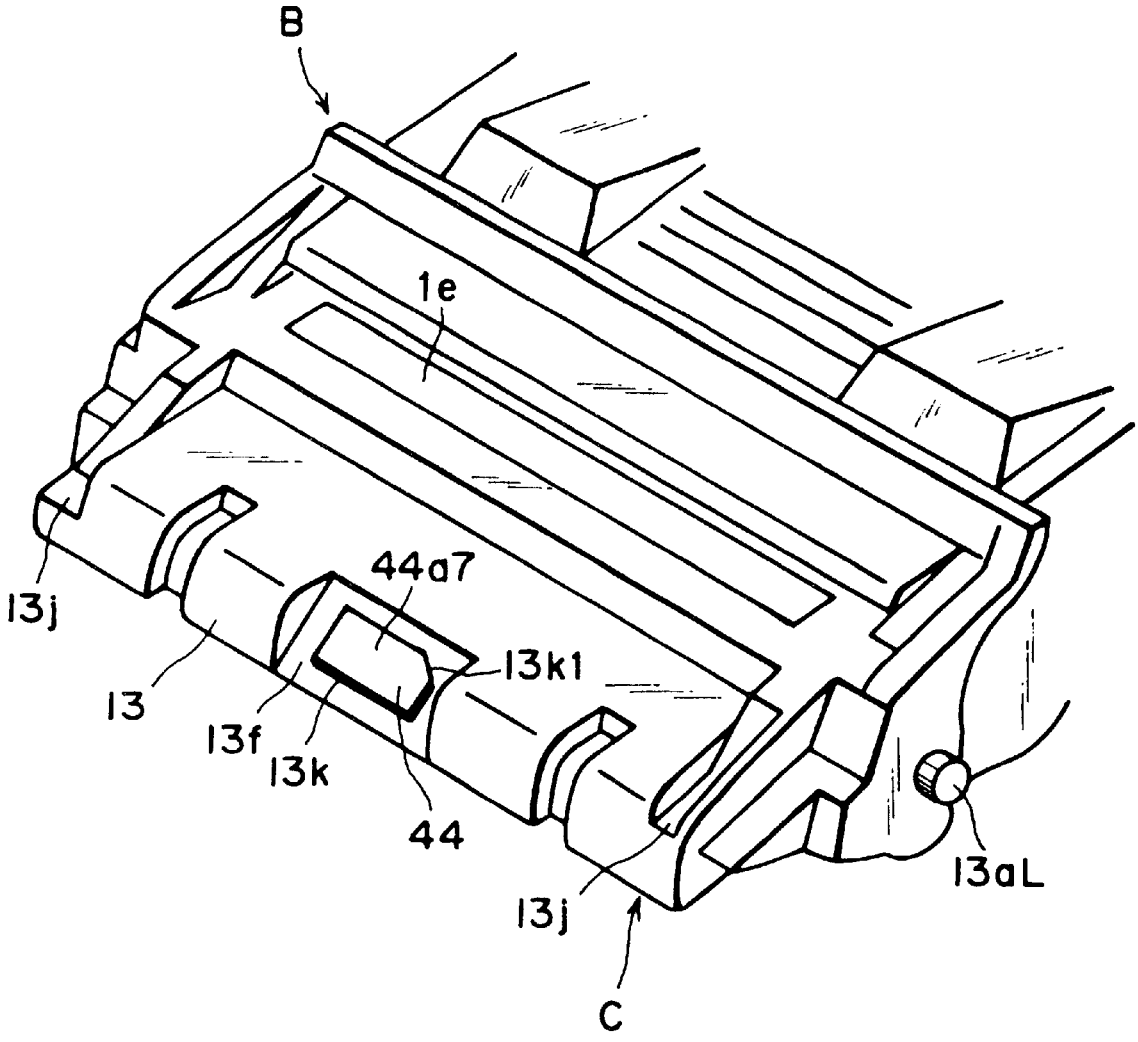
FIG. 29 is an illustration of an example of a process cartridge having a recess for protecting the memory unit.
Figure 30:
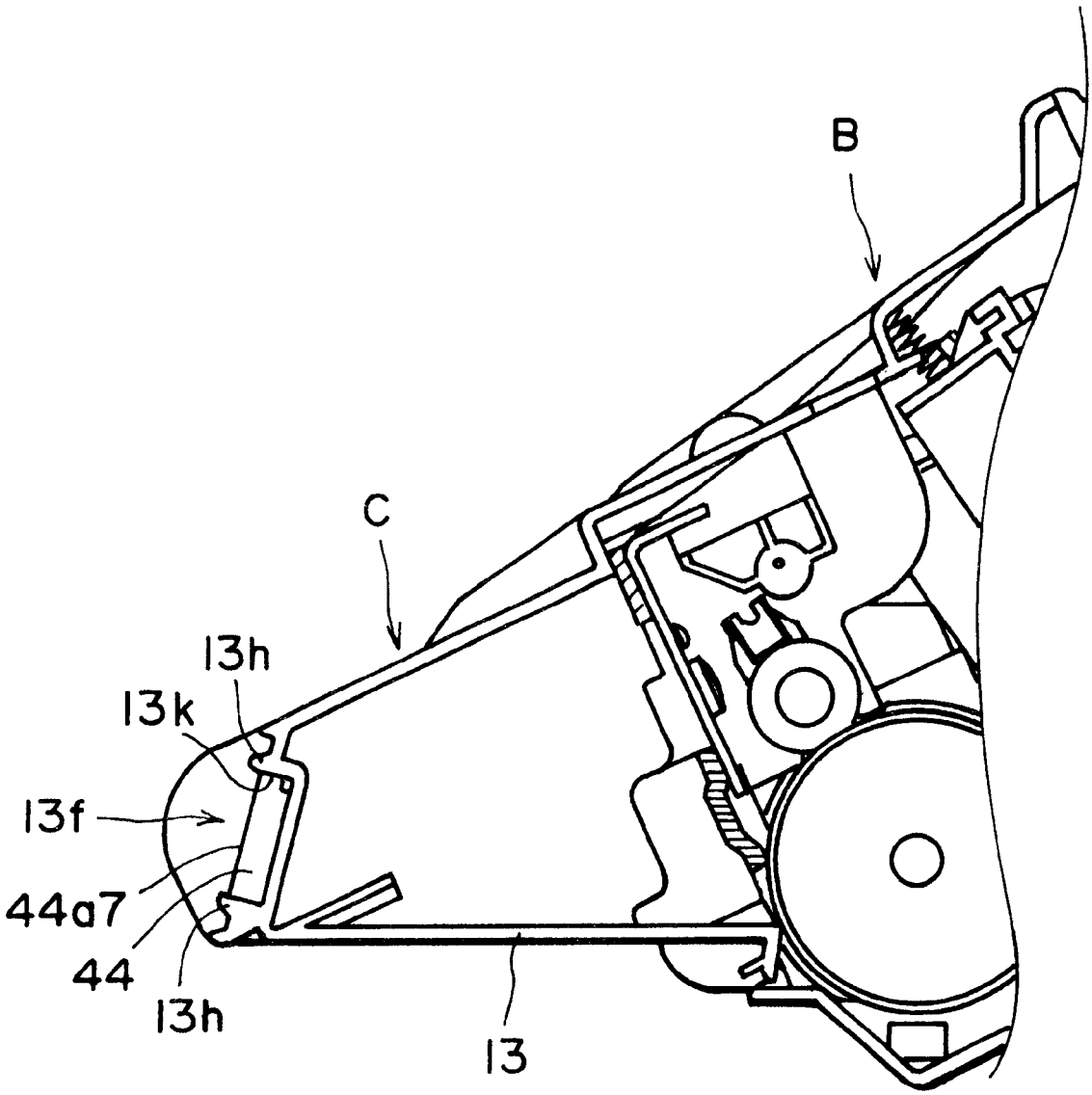
FIG. 30 is a sectional view of a process cartridge shown in FIG. 28.
Figure 31:
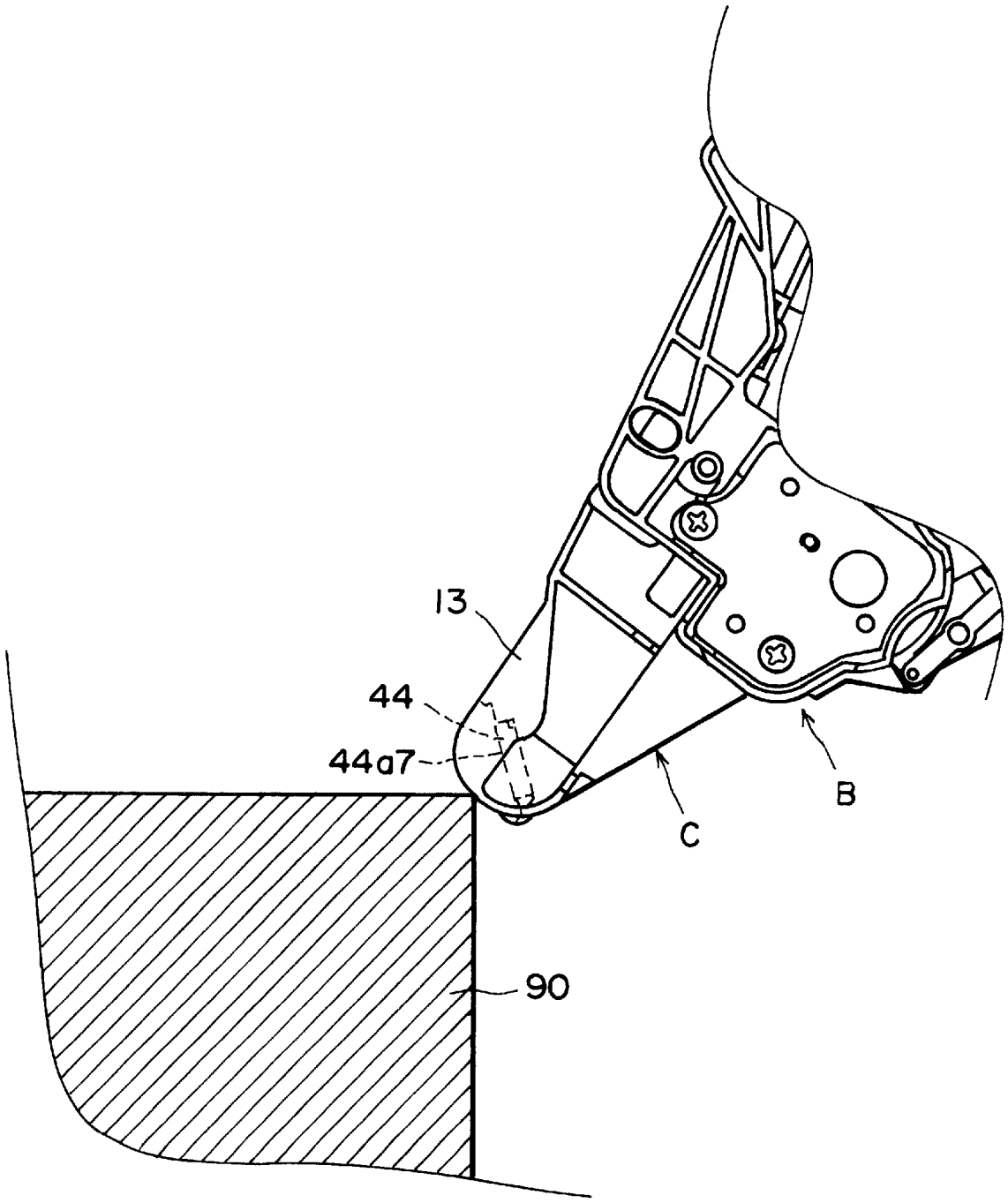
FIG. 31 is an illustration of protection of the memory unit.
Figure 32:
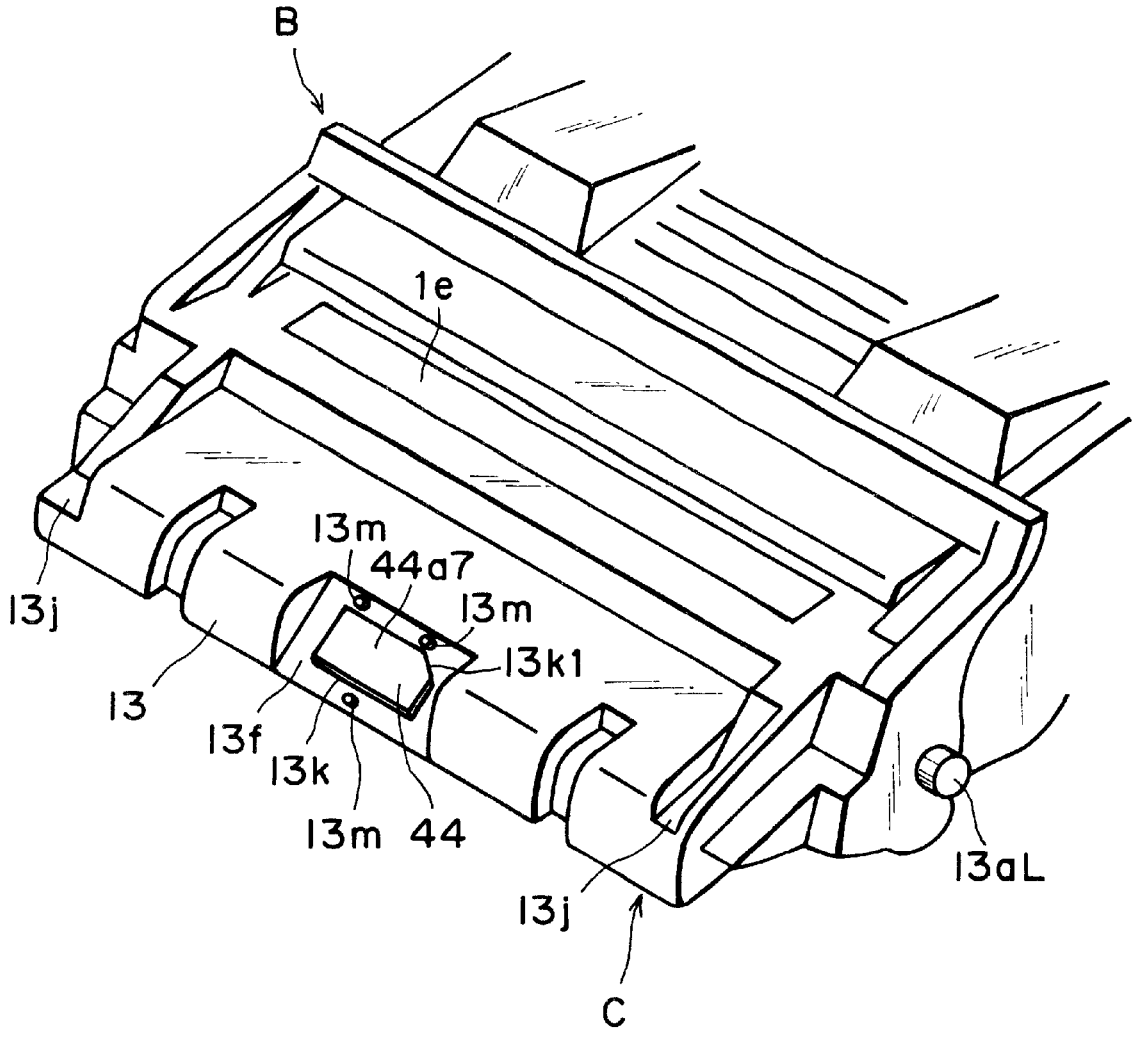
FIG. 32 is an illustration of an example of a process cartridge having a projection for protection of the memory unit.

Referring to FIGS. 29 to 33, the description will be made as to a structure for protection of the memory unit 44. FIG. 29 is a perspective view of a cartridge having a recess for protection of a memory unit, FIG. 30 is a sectional view of the cartridge shown in FIG. 29, FIG. 31 is an illustration for explaining the reason why the memory unit is protected, and FIG. 32 is a perspective view of a cartridge having a projection for protection of the memory unit.

The storing element 44*b*1 of the unit 44 stores information for execution of image forming operation of the image forming apparatus A. Therefore, for the purpose of desirable correction of the image forming apparatus A, the unit 44 is without problem. One of the causes of the problem or defect of the unit 44 is a shock or impact to the unit 44. In order to avoid the shock, it is desirable to provide a structure for protection of the unit 44.

As shown in FIG. 29, according to this embodiment, a protection recess 13*f* is provided at a position where the antenna unit 41 is faced to the cleaner frame 13 of the cleaning unit C to protect the memory member. More particularly, the recess 13*f* is disposed substantially at the center of the cleaner frame 13 faced to the antenna unit 41 when the cartridge B is inserted in the longitudinal direction of the cartridge B to be mounted to the main assembly 14 of the apparatus. The depth of the recess 13*f* is larger than the thickness of the unit 44. The memory unit 44 is disposed in the recess 13*f*. The bottom surface of the recess 13*f* is provided with the mounting portion 13*k* described foregoing, the unit 44 is mounted on the mounting portion 13*k* using a double coated tape or another method. The recess 13*f* is larger in the longitudinal direction of the cartridge B than the size of the antenna unit 41. Therefore, when the cartridge B is mounted to the main assembly 14, the antenna unit 41 can enter the recess 13*f*.

Therefore, the boss 13*h* (13*m*) mounted to the recess 13*f* is abutted to the leading side surface 41*d* of the antenna unit 41. more particularly, when the cartridge B is mounted to the main assembly 14 of the apparatus, the memory unit 44 is abutted to the antenna unit 41 at the leading end portion with respect to the mounting direction X1 through the boss 13*h* (13*m*). the distance between the antennas 41*c*, 44*b*2 of the memory unit 44 and the antenna unit 41 is properly maintained by the abutment of the leading side surface 41*d* to the boss 13*h* (13*m*) and by an equalizer mechanism 70 which will be described hereinafter. Here, the leading side surface 41*d* of the unit 41 is the surface which is at the leading side with respect to the mounting direction X1. the leading side surface 44*a*7 of the memory unit 44 is the surface which is disposed at the leading side in the mounting direction X1 when the cartridge B is mounted to the main assembly 14 of the apparatus.

By disposing the unit 44 in the recess 13*f* of the cleaner frame 13, the unit 44 can be protected from the direct impact to the unit 44. As shown in FIG. 31, for example, even if the cleaning unit C of the cartridge B hits a corner of a desk 60, the unit 44 is not subjected to a direct impact since the unit 44 is provided in the recess 13*f* of the cleaner frame 13. Therefore, the frame member 44*a* of the unit 44 and therefore the information written in the storing element 44*b*1 are protected from damage.

As shown in FIG. 32, a protecting projection (a rib 13*g* surrounding an outer periphery of the unit 44) for protection of the memory member may be provided at a position where the cleaner frame 13 is faced to the unit 41. The height of the rib 13*g* is larger than the thickness of the memory unit 44. By the provision of the rib 13*g* which enclosed the outer periphery of the unit 44, and by disposing the unit 44 in the area enclosed by the rib 13*g*.

In this embodiment, when the cartridge B is mounted to the main assembly 14 of the apparatus, the antenna unit 41 enters the area enclosed with the rib 13*g*. By doing so, the memory unit 44 and the antenna unit 41 are abutted to each other.

As described in the foregoing, the unit 44 is detachably mounted to the mounting portion 13*k* provided in the cleaner frame 13 with a proper mounting means such as a double coated tape. Accordingly, the unit 44 is prevented from disengaging from the cleaning unit C upon contact to the unit 41.

III. Wireless Communicating Mechanism

Referring to FIGS. 1, 7, 8, 36, 37, the description will be made as to the structure of the wireless communicating mechanism.

General Arrangement of the Wireless Communicating Mechanism

The wireless communicating mechanism comprises a communicating unit 47 and a memory unit 41.

Figure 7:
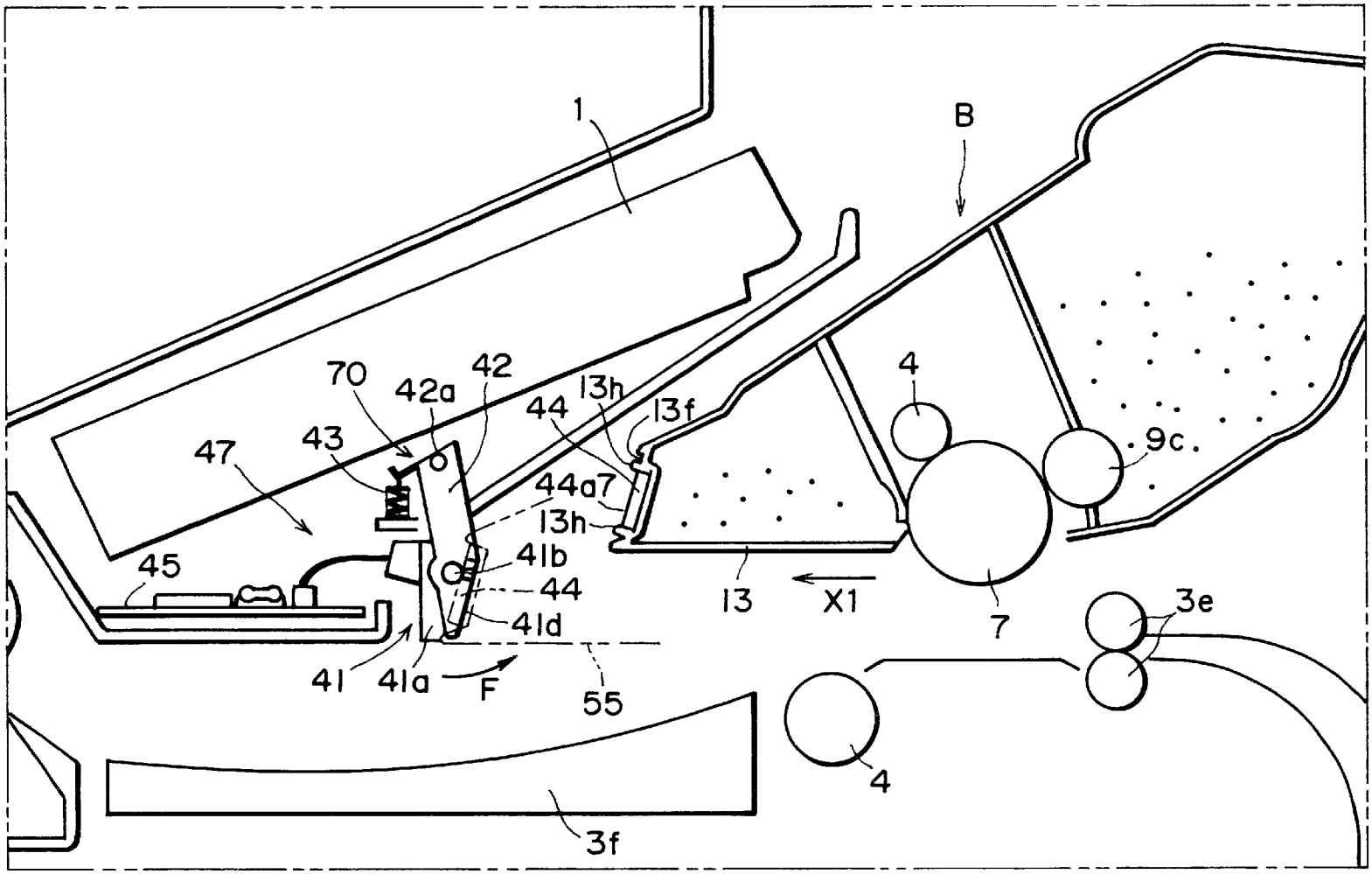
FIG. 7 is an illustration of a positional relation between the memory unit and the communicating unit in a process of insertion of the process cartridge into the main assembly of the apparatus.
Figure 8:
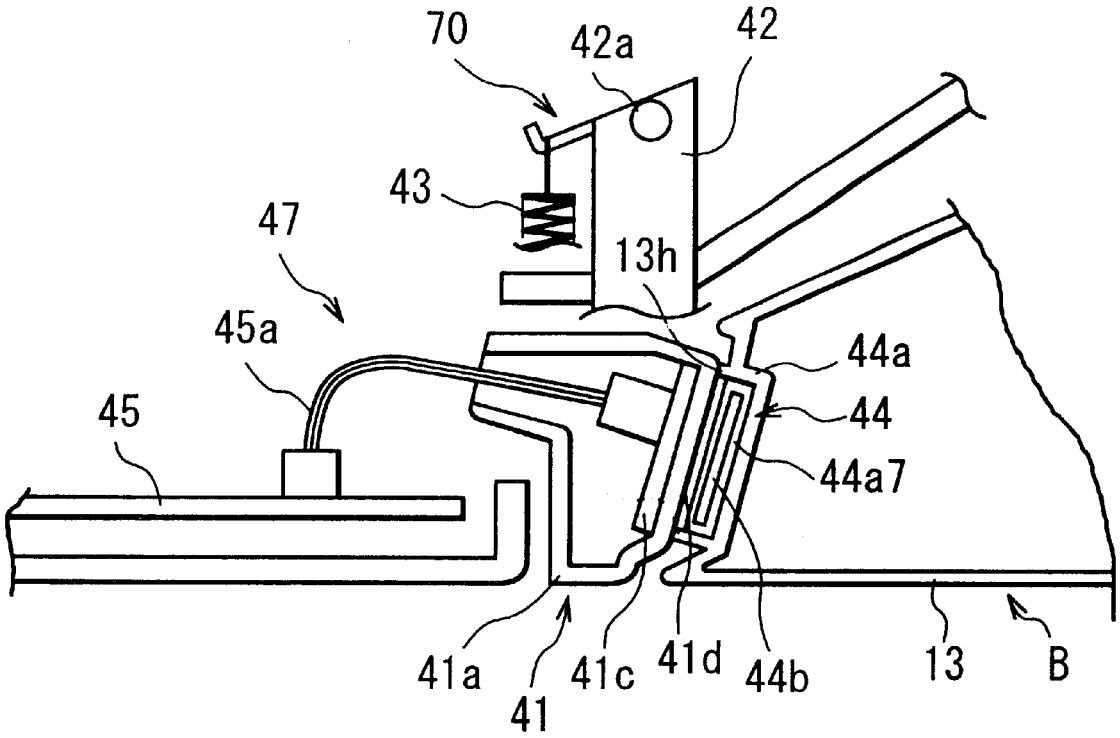
FIG. 8 is an illustration when the antenna unit of a communicating unit has been brought into contact to the memory unit.

The unit 47, as described hereinbefore, comprises an antenna unit 41, a unit 45 for controlling the unit 41 and an equalizer mechanism 70 (FIGS. 7, 8). The unit 41 and the unit 45 are electrically connected by a signal line 45*a*. The unit 41 comprises an antenna substrate 41*c* and an antenna cover 41*a* as an outer casing member covering the antenna substrate 41*c*. The material of the antenna cover 41*a* is selected from such materials as have a physical strength against the abutment to the memory unit 44 and as have a sufficient electrostatic shield property (dielectric constant 2–5 desirably). This means that material may be the same as the material of the frame member 44*a* of the memory unit 44.

The unit 41 is urged to be positioned in the insertion path 55 of the cartridge B by the supporting member 42, and is positioned by abutment to the past unit 44. The writing of the information into the memory unit 44 and the reading of the information from the memory unit 44 are carried out in response to instructions from the controlling unit 48 FIG. 1 by the communication controlling unit 45 acting on the memory unit 44 through the antenna unit 41.

Urging Mechanism for Antenna Unit, and Positioning Mechanism Therefor

Figure 33:
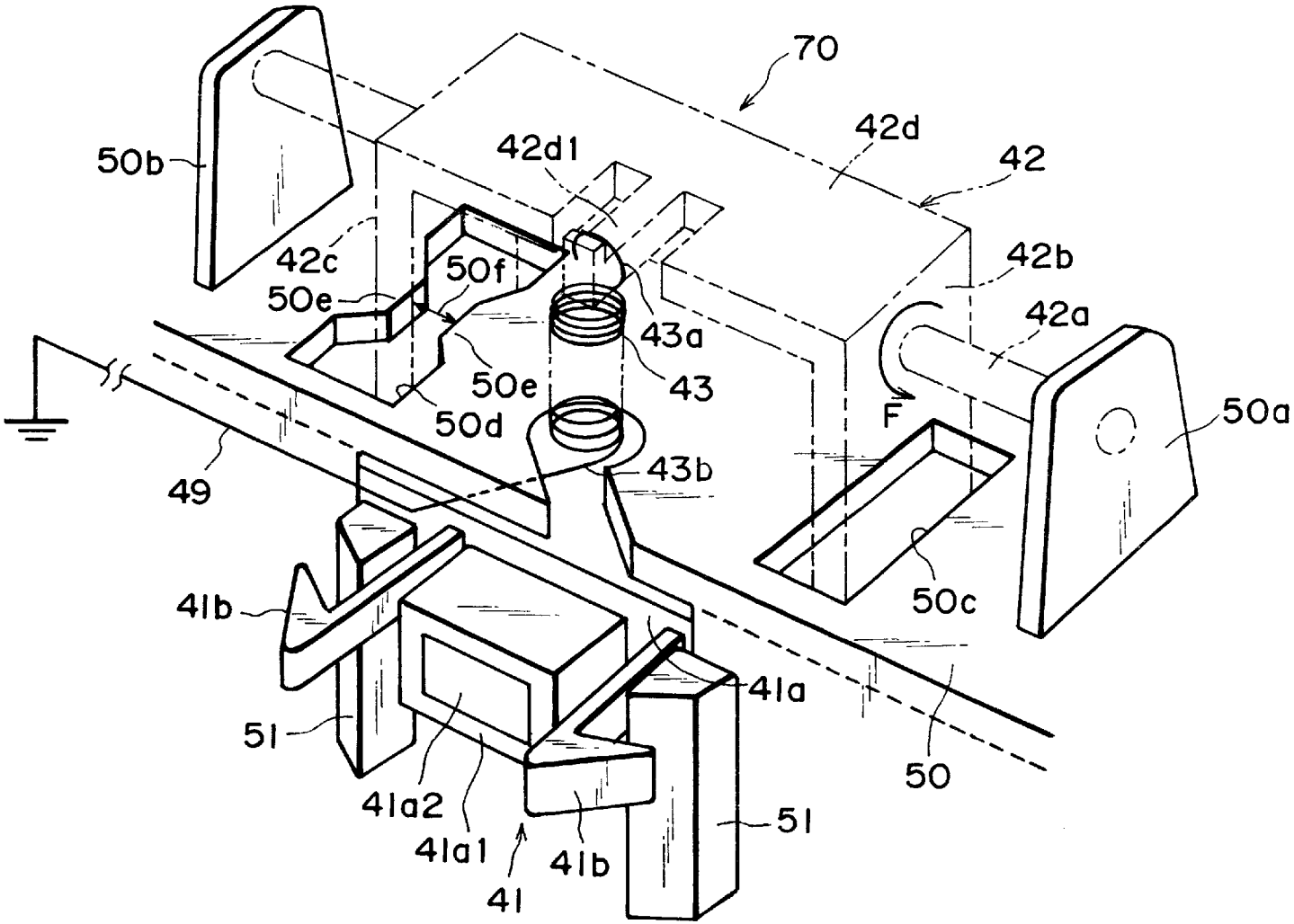
FIG. 33 shows details of a major part of an equalizer mechanism.
Figure 34:
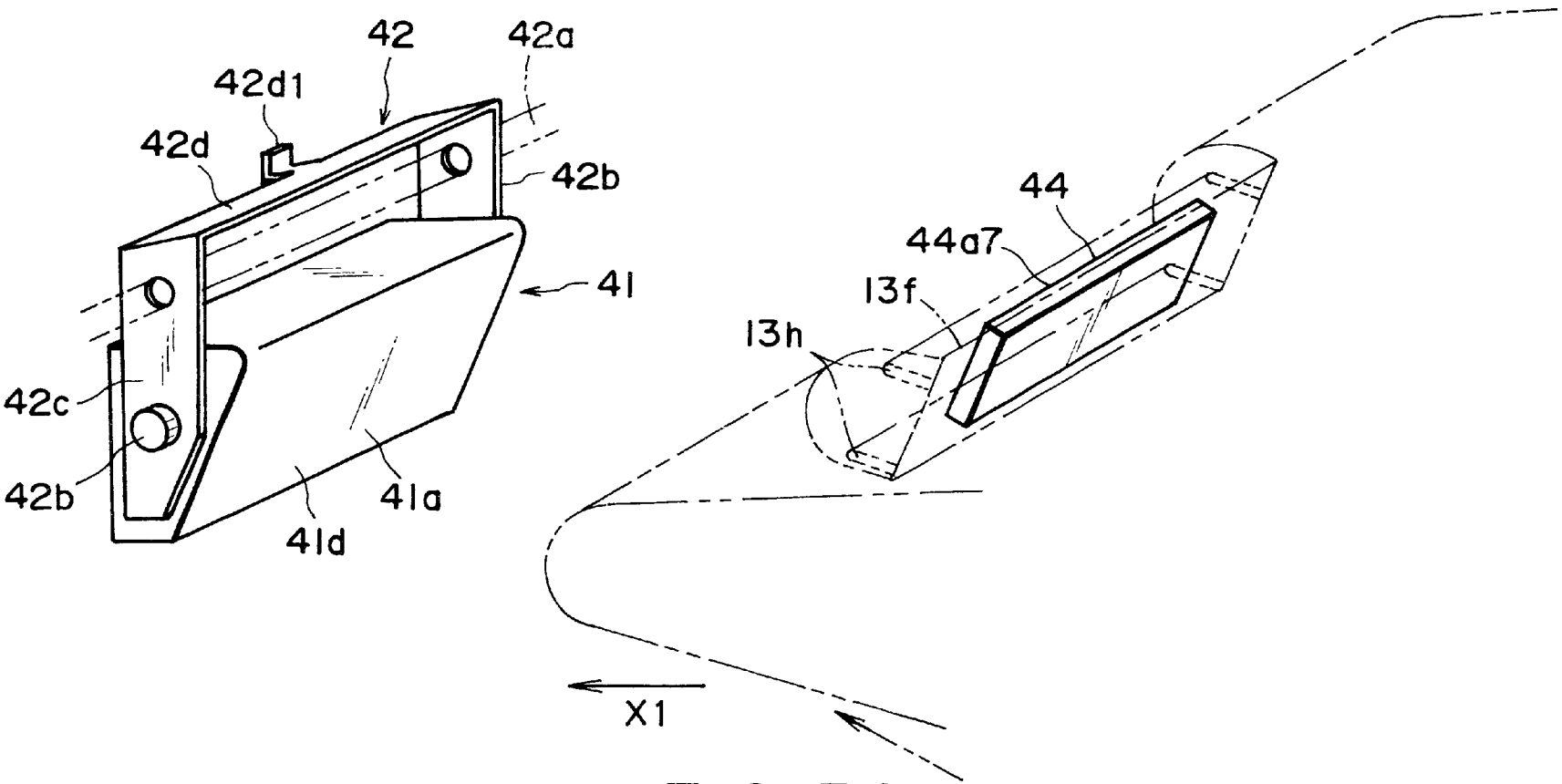
FIG. 34 is an exploded view of the antenna unit and the memory unit in the state of contact.

Referring to FIGS. 33, 34, the description will be made as to the urging mechanism and the positioning mechanism for the antenna unit.

In FIG. 33, designated by 50 is a main assembly frame provided in the main assembly 14 of the apparatus. The main assembly frame 50 has main assembly supporting members 50*a*, 50*b* which are opposed to each other in the longitudinal direction of the cartridge B. On the supporting members 50*a*, 50*b*, the supporting shaft 42*a* of the supporting member 42 the supported rotatably. The supporting member 42 comprises supporting portions 42*b*, 42*c* for supporting the unit 41 and a connecting portion 42*d* of connecting the supporting portions 42*b*, 42*c*. It is substantially in the form of a channel. The supporting portions 42*b*, 42*c* penetrate holes 50*c*, 50*d* formed in the main assembly frame 50.

The supporting member 42 is positioned so as to be immovable in the longitudinal direction of the cartridge B by one of the supporting portions 42*c* being placed in the gap 50*f* formed between the projections 50*e* which are provided substantially at a center of the hole 50*d*. The connecting portion 42*d* of the supporting member 42 is provided with a locking segment 42*d*1 with which a hook 43*a* of a spring 43 is engaged. The other end 43*b* of the spring 43 is sank into the lower surface of the main assembly frame 50 so that it is fixed to the main assembly frame 50. The other end 43*b* of the spring 43 is connected with a grounding portion of the main assembly 14 of the apparatus using an electroconductive lead 49. In this manner, by connecting the ends of the spring 43 with the supporting member 42 and the main assembly frame 50, thus providing an elastic force tension for urging the supporting member 42 toward the insertion path 55 of the cartridge B. Here, the spring 43 is of electroconductive material and is electrically grounded through an electroconductive lead 49.

Therefore, it functions as a conductor rod against static electricity.

As shown in FIG. 34, the supporting portions 42*a*, 42*b* of the supporting member 42 rotatably supports the antenna unit 41 by the supporting shaft 42*b*. The unit 41 is supported by the supporting member 42 purged by the spring 43, so that it is in the insertion path 55 of the cartridge B when there is no cartridge B. The unit 41 is provided with a pair of hooks 41*b* at a side of the cartridge B opposite from the insertion path 55. These hooks 41*b* are provided on the antenna cover 41*a*. These hooks 41*b* are engaged with projections 51 of the main assembly frame 50, when the antenna unit 41 is in the insertion path 55 of the cartridge B by the supporting member 42. Thus, the hook 41*b* functions as a stopper against rotational portion of the supporting member 42 the direction indicated by an arrow F in FIG. 8). The antenna cover 41*a* is substantially in the form of a box, and covers the antenna substrate 41*c* to protect it. The signal line 45*a* connecting the controlling unit 45 and the antenna substrate 41*c* of the unit 41 electrically connects them through a window 41*a*2 forming the cylindrical portion 41*a*1 constituting a part of the antenna cover 41*a*.

With the communicating unit 47 having the equalizer mechanism 70 having the above-described structure, the antenna unit 41 is in the insertion path 55 of the cartridge B when the cartridge B is not mounted to the main assembly 14 of the apparatus. When the cartridge B is inserted into the main assembly 14 of the apparatus, the unit 41 is brought into abutment the unit 44. At this time, the unit 44 is rotatably supported, and in the supporting member 42 is rotatably supported by the supporting shaft 41*a*. Therefore, with the further insertion of the cartridge B, it is retracted from the insertion path 55. With the cartridge B completely inserted into the main assembly 14 of the apparatus, the unit 41 is rotated, the supporting shaft 42*b* following the unit 44. By this, the antenna unit 41 is abutted to the surface of the memory unit 44 such that surfaces of them are parallel to each other. In this manner, the facing positions of the antenna unit 41 and the memory unit 44 are determined.

Figure 35:
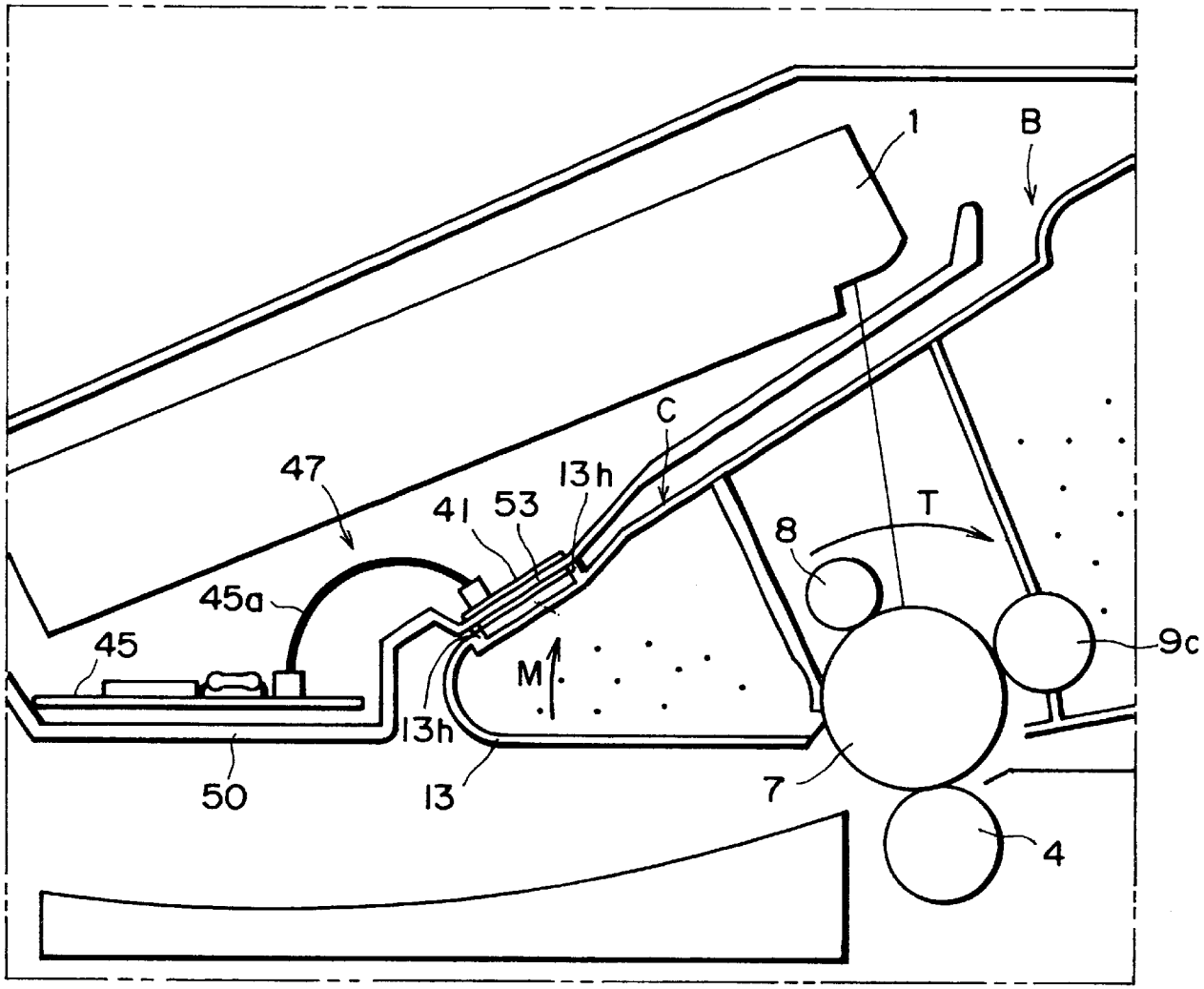
FIG. 35 is an illustration of a further example of the antenna unit urging mechanism and positioning mechanism.

Another Example of Urging Mechanism and Positioning Mechanism for the Antenna Unit FIG. 35 shows an urging mechanism and a positioning mechanism for the antenna unit according to a further example. FIG. 35 is an enlarged view of the contact portions between the memory unit 44 and the antenna unit 41.

According to this embodiment, the antenna unit 41 and the memory unit 44 can be abutted to each other without imparting an additional force against the positioning motion of the cartridge B.

As described in the foregoing, the positioning of the cartridge B relative to the main assembly 14 of the apparatus, is accomplished by the regulating abutment 13*j* and the cylindrical guides 13*a*R, 13*a*L. Namely, the cartridge B is supported by the cylindrical guides 13*a*R, 13*a*L provided coaxially with the photosensitive drum 7, by which the cartridge B is partly positioned relative to the main assembly 14 of the apparatus. The photosensitive drum 7 receives torque in the direction T from the main assembly 14 of the apparatus. By this, the neighborhood of the memory unit 44 provided on the upper surface of the cleaning unit C is urged in the direction M. Therefore, the position of the cartridge B is determined in the direction of the axis of the photosensitive drum 7 in the plane of this Figure. In the rotational direction M direction of the cartridge B is positioned by abutment of the cleaning unit C to a rotation stopper 53 of the main assembly frame 50. In this example, the antenna unit 41 is disposed at the rotation stopper portion 53.

By doing so, the antenna unit 41 and the memory unit 44 are abutted to each other without additional force against the positioning of the cartridge B.

In this embodiment, the equalizer mechanism 70 is provided in the main assembly 14 of the apparatus, but an equalizer mechanism having the same function may be provided in the cartridge B. For example, in the case that antenna unit 41 is fixed to the main assembly 14 of the apparatus, the unit 44 may be mounted to the cleaning unit C with an equalizer mechanism therebetween such that position of the memory unit 44 is determined to be aligned with the antenna unit 41. By this, when the cartridge B is completely inserted into the main assembly 14 of the apparatus, the unit 44 is correctly faced to the unit 41.

With the use of the wireless communicating mechanism described in the foregoing, the memory unit 44 is contacted by the antenna cover 41*a* functioning as a protection layer of minimum necessity in the physical strength and the durability against the electrostatic failure and by the frame member 44*a*. Therefore, the electric power required for the wireless communication can be minimized, so that assured wireless communication is accomplished with small power. This eliminates the necessity for the shield for preventing leakage for the radio wave. Thus, the power required by the wireless communication is minimized. In addition, since a small power is enough, the electric energy consumption is saved, and therefore, the electric circuit may be small and inexpensive.

In the case that wireless communicating mechanism is used in an electrophotographic image forming apparatus A, the provision of the abutment portion for abutment between the memory unit 44 mounted to the cartridge B and a part (antenna unit 41 in this embodiment) of the communicating unit 47 provided in the main assembly 14 of the apparatus, is effective to assure the abutment between the communicating unit 47 and the memory unit 44 without disturbing the positioning of the cartridge B. Therefore, reading and writing of the necessary information can be accomplished with high precision. By supporting the antenna unit 41 with a mechanism permitting swing equalization, the abutment relative to the memory unit 44 is assured with minimum contact pressure. Therefore, the communication is assured without disturbances to the positioning of the cartridge B.

The communicating unit 47 is separated into two bodies, namely, the antenna unit 41 and the controlling unit 45. Therefore, the antenna unit 41 can be closely contacted to the memory unit 44 with a weak force. Thus, the relative positioning between the memory unit 44 and the antenna unit 41 is accomplished without deteriorating the positioning accuracy and the mounting-and-demounting operativity of the cartridge B. Since the relative position accuracy between the memory unit 44 and the antenna unit 41 is assured to be high, the power intensity of the electromagnetic field) can be minimized. By doing so, the wireless communication is accomplished with such a small power as does not require a magnetic shield. When the antenna unit 41 is exposed at a position contacted to the detachably mountable cartridge B, a static stopper is desired, but because of the two-body structure, what is required is only to cover the antenna unit 41. Therefore, the required cost is low.

The antenna unit 41 is capsuled in an electrostatically safe box form.

Therefore, the latitude of arrangements in the main assembly 14 of the apparatus is enhanced, and the antenna unit may be disposed at an exposed position subjected to contact by the user. Therefore, the memory unit 44 and the antenna unit 41 can be contacted to each other. Because the contact of the antenna unit 41 is accomplished, the power required for the communication is minimized such that magnetic shield or the like is unnecessarily. When the shield is required, the usage of the wireless communicating mechanism is very much limited. The unnecessity of the shield permits cost reduction. In addition, the wireless communicating mechanism can be used in the limited space in the main assembly 14 of the apparatus. In addition, since the required power is small, the electric energy consumption can be suppressed and the electric circuit can be minimized. Since the contact is enough without requiring insertion as with the case of a connector, and the mounting-and-demounting operativity of the cartridge B is not deteriorated.

In the embodiment, the antenna unit 41 is in the form of a box type capsule which is electrostatically safe, but the entirety of the communicating unit 47 may be in the form of a box type capsule which is electrostatically safe.

The spring 43 disposed adjacent the antenna unit 41 is of electroconductive material, and has an end 43*b* which is electrically grounded through the electroconductive line 49. Therefore, the spring 43 functions as a conductor rod. Therefore, even if the withstand voltage of the antenna cover 41*a* for protecting the antenna unit 41 is low, the electric discharge from the body of the user would not directly attack the unit 41. Therefore, the durability against electrostatic failure is high. Therefore, the antenna unit 41 can be provided at such a position that when the detachably mountable cartridge B is dismounted from the main assembly 14 of the apparatus, the antenna unit 41 may be touched by a users hand. These means that it can be disposed closest to the cartridge B. Because of the permissible low withstand voltage of the antenna cover 41*a,* the antenna cover 41*a* may be thin, or it may be constructed using joint and/or fitting. Therefore, the assembling easiness property of the antenna unit 41 is improved with the result of cost saving. The antenna unit 41 is abutted to the cartridge B by the electrically grounded spring 43 electroconductive member. Therefore, no additional forces imparted to the antenna unit 41, and therefore, the cartridge B can be inserted smoothly. Additionally, the necessity for an urging spring adjacent the antenna unit 41 can be eliminated. Therefore, the electrical interference due to the urging spring can be avoided.

The embodiments described in the foregoing are summarized as follows.

An unit (feeding unit 3*a,* fixing unit 5, developing unit) detachably mountable to a main assembly (14) of an electrophotographic image forming apparatus for forming an image on a recording material, comprising:

(a) a unit (feeding unit 3*a,* fixing unit 5, developing unit) including;

a unit frame (cartridge frame); and (b) a memory member (memory unit 44) provided in said process cartridge, said memory member (memory unit 44) having;

a base (base plate 44*b*3);

a storing element (44*b*1), provided on said base (base plate 44*b*3), for storing information;

a memory antenna (communication antenna 44*b*2), provided in said base (base plate 44*b*3), for sending the information stored in said storing element (44*b*1) to a main assembly (14) antenna (41*c*) provided in a main assembly (14) of the apparatus, when said memory member (memory unit 44) is mounted to the main assembly (14) of the apparatus;

a sending member (communication circuit 44*b*11), provided in said base (base plate 44*b*3), for sending the information stored in said storing element (44*b*1) to said memory antenna (communication antenna 44*b*2); and an outer casing member (frame member 44*a*) covering said base (base plate 44*b*3) provided with said storing element (44*b*1), said sending member (communication circuit 44*b*11) and said memory antenna (communication antenna 44*b*2), wherein when said unit is mounted to the main assembly (14) of apparatus, the unit frame (cartridge frame) is contacted to a main assembly (14) antenna (41*c*) cover (41*a*) provided in the main assembly (14) of the apparatus.

A process cartridge (B) detachably mountable to a main assembly (14) of an electrophotographic image forming apparatus for forming an image on a recording material, comprising:

(a) electrophotographic photosensitive member (7);

(b) process means (charging means 8, developing means 9, cleaning means 10) actable on said electrophotographic photosensitive member (7);

(c) a cartridge frame (cleaning frame 13);

(d) a memory member (memory unit 44) provided in said cartridge frame (cleaning frame 13), said memory member (memory unit 44) including;

a base (base plate 44*b*3);

a storing element (44*b*1), provided on said base (base plate 44*b*3), for storing information;

a memory antenna (communication antenna 44*b*2), provided on said base (base plate 44*b*3), for sending the information stored in said storing element (44*b*1) to a main assembly (14) antenna (41*c*) provided in the main assembly (14) of the apparatus when said process cartridge (B) is mounted to the main assembly (14) of the apparatus;

a sending member (communication circuit 44*b*11), provided in said base (base plate 44*b*3), for sending the information stored in said storing element (44*b*1) to said memory antenna (communication antenna 44*b*2); and an outer casing member (frame member 44*a*) covering said base (base plate 44*b*3) provided with said storing element (44*b*1), said sending member (communication circuit 44*b*11) and said memory antenna (communication antenna 44*b*2), wherein when said process cartridge (B) is mounted to the main assembly (14) of apparatus, the unit frame (cartridge frame) is contacted to a main assembly (14) antenna (41*c*) cover (41*a*) provided in the main assembly (14) of the apparatus.

It may be that said unit frame (cartridge frame) contactable to the main assembly (14) antenna (41*c*) cover (41*a*) is uniform of an elongated projection (13*h*) extended in a longitudinal direction of said memory member.

It may be that said projection is extended in the longitudinal direction of said memory member (memory unit 44) at each of opposite lateral ends of said memory member.

It may be that said unit frame (cartridge frame) contactable to the main assembly (14) antenna (41*c*) cover (41*a*) is in the form of a circular column projection provided at each of opposite lateral ends of said memory member.

It may be that said unit is a fixing unit for fixing on the recording material a toner image transferred onto it, a developing unit for developing an electrostatic latent image formed on an electrophotographic photosensitive member (7), or a feeding unit accommodating the recording material.

Other Embodiments

In the foregoing, the description has been made with respect to Embodiments in which the wireless communicating mechanism comprising the communicating unit and the memory unit is used in a cartridge, but this usage is not limiting. It is applicable to a feeding cassette for accommodating recording materials in the main body unit frame of the cassette, if the feeding cassette is demountable from the main assembly of the apparatus. It is also applicable to a fixing unit comprising a unit frame, a pressing roller and a fixing roller which are supported by the unit frame to fix toner images on recording materials if the fixing unit is demountable from the main assembly of the apparatus. It is also preferably applicable to a developing unit comprising a unit frame, a developer container and developing means which are supported by the unit frame to develop electrostatic latent images formed on the electrophotographic photosensitive member with a developer, if the developing unit is detachably mountable to the main assembly of the apparatus. Therefore, the unit to which the present invention is applicable includes a feeding cassette, a fixing unit and a developing unit.

The process cartridge B to which the present invention is applicable is not limited to a process cartridge for formation of the monochromatic image is, but maybe a color cartridge for formation of multicolor image is (two-color images, three-color images, full-color images or the like) using a plurality of developing means.

In the above-described, the electrophotographic photosensitive member has been described as photosensitive drum, but the electrophotographic photosensitive member is not limited to such a photosensitive drum, but the following is usable. The photosensitive member may be a photoconductor which may be an amorphous silicon, amorphous selenium, zinc oxide, titanium oxide, organic photoconductor (OPC) or the like. The photosensitive member may be in the form of a drum, a belt or another rotatable member, or a sheet, or the like. Generally, however, a drum or a belt is used, and in the case of a drum type photosensitive member, a cylinder of aluminum alloy or the like is coated with a photoconductor by evaporation or application or the like.

Also, the present invention is preferably usable with various known developing methods such as the magnetic brush developing method using two component toner, the cascade developing method, the touch-down developing method, the cloud developing method.

The structure of the charging means described in the foregoing is of a so-called contact type charging method, but a known charging means comprising a tungsten wire which is enclosed width metal shield of aluminum or the like at three sides, wherein positive or negative ions generated by application of a high voltage to said tungsten wire are directed to the surface of the photosensitive drum to uniformly charged the surface, is usable.

The charging means may be a roller type as described in the foregoing, a blade type (charging blade), a pad type, a block type, a rod type, a wire type or the like.

As for a cleaning method for removing toner remaining on the photosensitive drum, a blade, a furbrush, a magnetic brush or the like is usable.

The process cartridge, for example, comprises an electrophotographic photosensitive member and at least one process means. As for the types of the process cartridge, there are, in addition to those disclosed hereinbefore, a type in which, for example, an electrophotographic photosensitive member and charging means are unified integrally into a cartridge which is detachably mountable to the main assembly of the electrophotographic image forming apparatus;. A type in which an electrophotographic photosensitive member and developing means are unified integrally into a cartridge which is detachably mountable to a main assembly of apparatus. A type in which an electrophotographic photosensitive member and cleaning means are unified integrally into a cartridge which is detachably mountable to a main assembly of an electrophotographic image forming apparatus,. A type in which an electrophotographic photosensitive member and two or more of the process means are combined integrally into a cartridge which is detachably mountable to a main assembly of an electrophotographic image forming apparatus.

The process cartridge may integrally contain an electrophotographic photosensitive drum, and charging means, developing means or cleaning means, in the form of a unit or a cartridge, which is detachably mountable to a main assembly of an image forming apparatus. The process cartridge may integrally contain an electrophotographic photosensitive drum, and at least one of charging means, developing means and cleaning means, in the form of a unit or a cartridge, which is detachably mountable to a main assembly of an image forming apparatus. Furthermore, the process cartridge may contain at least the electrophotographic photosensitive drum and the developing means, in the form of a unit or a cartridge, which is detachably mountable to a main assembly of an image forming apparatus. The process cartridge is mounted to or demounted from the main assembly of the apparatus by the user. This means that maintenance of the apparatus is carried out, in effect, by the user.

In the foregoing embodiments, a laser beam printer has been taken as examples of the electrophotographic image forming apparatus, but the present invention is not limited thereto, and the present invention is applicable to an electrophotographic copying machine, a facsimile machine, a facsimile machine or the like of an electrophotographic type.

As described in the foregoing, according to the present invention, the gap between the memory antenna and the main assembly antenna can be maintained correctly.

An addition, according to the present invention, a unit capable of wireless communication is provided.

Additionally, according to the present invention, a process cartridge capable of wireless communication is provided.

Furthermore, according to the present invention, there is provided an electrophotographic image forming apparatus to which a unit capable of wireless communication is detachably mountable.

Moreover, according to the present invention, there is provided an electrophotographic image forming apparatus to which a process cartridge capable of wireless communication.

While the invention has been described with reference to the structures disclosed herein, it is not confined to the details set forth and this application is intended to cover such modifications or changes as may come within the purpose of the improvements or the scope of the following claims.

What is claimed is:

1. A unit detachably mountable to a main assembly of an electrophotographic image forming apparatus for forming an image on a recording material, wherein the main assembly includes a main assembly antenna and a main assembly antenna cover for covering the main assembly antenna, said unit comprising:

(i) a unit frame; and (ii) a memory member provided in said unit frame, said memory member having:

a base;

a storing element, provided on said base, for storing information;

a memory antenna, provided in said base, for sending the information stored in said storing element to the main assembly antenna when said unit is mounted to the main assembly of the apparatus;

a sending member, provided in said base, for sending the information stored in said storing element to said memory antenna; and an outer casing member covering said base, said storing element, said sending member, and said memory antenna, wherein when said unit is mounted to the main assembly of the apparatus, said unit frame contacts the main assembly antenna cover.

2. A unit according to claim 1, wherein said unit frame contactable to the main assembly antenna cover is in the form of an elongated projection extending in a longitudinal direction of said memory member.

3. A unit according to claim 2, wherein said projection extends in the longitudinal direction of said memory member at each of opposite lateral ends of said memory member.

4. A unit detachably mountable to a main assembly of an electrophotographic image forming apparatus for forming an image on a recording material, wherein the main assembly includes a main assembly antenna and a main assembly antenna cover for covering the main assembly antenna, said unit comprising:

(i) a unit frame; and (ii) a memory member provided in said unit frame, said memory member having:

a base;

a storing element, provided on said base, for storing information;

a memory antenna, provided in said base, for sending the information stored in said storing element to the main assembly antenna when said unit is mounted to the main assembly of the apparatus;

a sending member, provided in said base, for sending the information stored in said storing element to said memory antenna; and an outer casing member covering said base, said storing element, said sending member, and said memory antenna, wherein when said unit is mounted to the main assembly of the apparatus, said unit frame contacts the main assembly antenna cover, and wherein said unit frame contactable to the main assembly antenna cover is in the form of a circular column projection provided at each of opposite lateral ends of said memory member.

5. A unit according to any one of claims 1–4, wherein said unit is a fixing unit for fixing on the recording material a toner image transferred thereonto, a developing unit for developing an electrostatic latent image formed on an electrophotographic photosensitive member, or a feeding unit accommodating the recording material.

6. A unit according to claim 1, wherein said memory member is disposed in a recess of said unit frame.

7. A process cartridge detachably mountable to a main assembly of an electrophotographic image forming apparatus for forming an image on a recording material, wherein the main assembly includes a main assembly antenna and a main assembly antenna cover for covering the main assembly antenna, said process cartridge comprising:

(i) an electrophotographic photosensitive member;

(ii) process means actable on said electrophotographic photosensitive member;

(iii) a cartridge frame; and (iv) a memory member provided in said cartridge frame, said memory member including:

a base;

a storing element, provided on said base, for storing information;

a memory antenna, provided on said base, for sending the information stored in said storing element to the main assembly antenna when said process cartridge is mounted to the main assembly of the apparatus;

a sending member, provided in said base, for sending the information stored in said storing element to said memory antenna; and an outer casing member covering said base, said storing element, said sending member, and said memory antenna, wherein when said process cartridge is mounted to the main assembly of the apparatus, said cartridge frame contacts the main assembly antenna cover.

8. A process cartridge according to claim 7, wherein said cartridge frame contactable to the main assembly antenna cover is in the form of an elongated projection extending in a longitudinal direction of said memory member.

9. A process cartridge according to claim 8, wherein said projection extends in the longitudinal direction of said memory member at each of opposite lateral ends of said memory member.

10. A process cartridge detachably mountable to a main assembly of an electrophotographic image forming apparatus for forming an image on a recording material, wherein the main assembly includes a main assembly antenna and a main assembly antenna cover for covering the main assembly antenna, said process cartridge comprising:

(i) an electrophotographic photosensitive member;

(ii) process means actable on said electrophotographic photosensitive member;

(iii) a cartridge frame; and (iv) a memory member provided in said cartridge frame, said memory member including:

a base;

a storing element, provided on said base, for storing information;

a memory antenna, provided on said base, for sending the information stored in said storing element to the main assembly antenna when said process cartridge is mounted to the main assembly of the apparatus;

a sending member, provided in said base, for sending the information stored in said storing element to said memory antenna; and an outer casing member covering said base, said storing element, said sending member, and said memory antenna, wherein when said process cartridge is mounted to the main assembly of the apparatus, said cartridge frame contacts the main assembly antenna cover, and wherein said cartridge frame contactable to the main assembly antenna is in the form of a circular column projection at each of opposite lateral ends of said memory member.

11. An electrophotographic image forming apparatus, having a main assembly, for forming an image on a recording material, to which apparatus a unit is detachably mountable, said apparatus comprising:

(i) a main assembly antenna covered with a main assembly antenna cover;

(ii) a main assembly antenna holding member for holding said main assembly antenna;

(iii) the unit, said unit including:

a unit frame; and a memory member provided in said unit frame, said memory member having:

a base;

a storing element, provided on said base, for storing information;

a memory antenna, provided in said base, for sending the information stored in said storing element to said main assembly antenna, when said unit is mounted to the main assembly of said apparatus;

a sending member, provided in said base, for sending the information stored in said storing element to said memory antenna; and an outer casing member covering said base, said storing element, said sending member, and said memory antenna; and (iv) feeding means for feeding the recording material, wherein when said unit is mounted to the main assembly of said apparatus, said unit frame contacts said main assembly antenna cover.

12. An electrophotographic image forming apparatus, having a main assembly, for forming an image on a recording material, to which apparatus a process cartridge is detachably mountable, said electrophotographic image forming apparatus comprising:

(i) a main assembly antenna covered with a main assembly antenna cover;

(ii) a main assembly antenna holding member for holding said main assembly antenna;

(iii) said process cartridge, wherein said process cartridge includes:

an electrophotographic photosensitive member;

process means actable on said electrophotographic photosensitive member;

a cartridge frame;

a memory member provided in said cartridge frame, said memory member having:

a base;

a storing element, provided on said base, for storing information;

a memory antenna, provided on said base, for sending the information stored in said storing element to a main assembly antenna when said process cartridge is mounted to the main assembly of said apparatus;

a sending member, provided in said base, for sending the information stored in said storing element to said memory antenna; and an outer casing member covering said base, said storing element, said sending member, and said memory antenna; and (iv) feeding means for feeding the recording material, wherein when said process cartridge is mounted to the main assembly of said apparatus, the cartridge frame contacts said main assembly antenna cover.

13. A process cartridge according to claim 7, wherein said memory member is disposed in a recess of said cartridge frame.

* * * * *

UNITED STATES PATENT AND TRADEMARK OFFICE

CERTIFICATE OF CORRECTION

PATENT NO. : 6,654,567 B2
DATED : November 25, 2003
INVENTOR(S) : Toshiyuki Karakama et al.

It is certified that error appears in the above-identified patent and that said Letters Patent is hereby corrected as shown below:

Title page,
Item [56], References Cited, FOREIGN PATENT DOCUMENTS, "11348375" should read -- 11-348375 --.

Column 30,
Line 24, "cover" should read -- cover, and -- .

Column 31,
Line 34, "cover" should read -- cover, and --.
Line 48, "the unit," should read -- said unit, --.

Column 32,
Line 48, "the" should read -- said --.

Signed and Sealed this

Third Day of August, 2004

JON W. DUDAS
*Acting Director of the United States Patent and Trademark Office*